US008955842B2

(12) United States Patent
Sawanaka et al.

(10) Patent No.: US 8,955,842 B2
(45) Date of Patent: Feb. 17, 2015

(54) IMAGE FORMING APPARATUS

(75) Inventors: Kei Sawanaka, Susono (JP); Takashi Seki, Tokyo (JP); Jiroh Itoh, Kashiwa (JP); Kazuaki Takahashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/421,006

(22) Filed: Mar. 15, 2012

(65) Prior Publication Data

US 2012/0242032 A1 Sep. 27, 2012

(30) Foreign Application Priority Data

Mar. 23, 2011 (JP) ..... 2011-064336

(51) Int. Cl.
*B65H 5/02* (2006.01)
*G03G 15/16* (2006.01)

(52) U.S. Cl.
CPC ..... *G03G 15/1615* (2013.01)
USPC ..... 271/275; 399/303; 399/313

(58) Field of Classification Search
CPC ..... G03G 15/1615; G03G 2215/00143; G03G 2215/00151; B65H 39/16
USPC ..... 399/275, 276, 302, 303, 308, 312, 313; 198/806, 840; 271/275
See application file for complete search history.

(56) References Cited

U.S. PATENT DOCUMENTS

| | | | | |
|---|---|---|---|---|
| 7,680,445 | B2 | 3/2010 | Kim | |
| 8,190,073 | B2 * | 5/2012 | Watanabe et al. | 399/308 |
| 8,433,225 | B2 * | 4/2013 | Michibata | 399/302 |

FOREIGN PATENT DOCUMENTS

| | | | | |
|---|---|---|---|---|
| CN | 101334599 | A | | 12/2008 |
| JP | 10-268660 | A | | 10/1998 |
| JP | 11-20975 | A | | 1/1999 |
| JP | 3037387 | B2 | | 4/2000 |
| JP | 2004-101599 | A | | 4/2004 |
| JP | 2004101599 | A | * | 4/2004 |
| JP | 2008-090125 | A | | 4/2008 |
| JP | 2009-75377 | A | | 4/2009 |
| JP | 2010-72071 | A | | 4/2010 |
| JP | 2010-79044 | A | | 4/2010 |

OTHER PUBLICATIONS

Chinese Office Action dated Aug. 26, 2014, in related Chinese Patent Application No. 201210080335 (with English Translation).

* cited by examiner

*Primary Examiner* — Jeremy R Severson
(74) *Attorney, Agent, or Firm* — Fitzpatrick, Cella, Harper & Scinto

(57) ABSTRACT

A belt unit includes a rotatable endless belt for receiving a toner image thereon or for conveying a transfer material, wherein the endless belt has a smooth-shaped inner peripheral surface, a first reinforcing member, provided on an outer peripheral surface of the endless belt at one end portion with respect to a belt widthwise direction, for reinforcing the endless belt, and a second reinforcing member, provided on the outer peripheral surface of the endless belt at the other end portion. In addition, a driving roller rotationally drives the endless belt while supporting the inner peripheral surface of the endless belt. In the belt widthwise direction, a first length from an inner edge surface of the first reinforcing member to an inner edge surface of the second reinforcing member is smaller than a width of a region in which the driving roller contacts the endless belt, and a second length from an outer edge surface of the first reinforcing member to an outer edge surface of the second reinforcing member is larger than the width of the region in which the driving roller contacts the endless belt.

11 Claims, 18 Drawing Sheets

(a)

(b)

(a)

(b)

(a)

| | OVERLAPPING | ➡ | BELT PERIOD |
|---|---|---|---|
| NTRL SRFC | MOVE OUTWARD | ➡ | SHORTEN |
| TNSL STRNGTH | STRENGTHEN | ➡ | SHORTEN |
| BLT ELNGTN | DECREASE | ➡ | SHORTEN |
| CRCMFRNC | SHORTEN | ➡ | SHORTEN |

(b)

(a)

(b)

(a)

(b)

(c)

(a)

(b)

(a)

(b)

IMAGE FORMING APPARATUS

FIELD OF THE INVENTION AND RELATED ART

The present invention relates to a belt unit which includes an endless belt stretched by rollers and which is used in an image forming apparatus such as a printer, a copying machine or a facsimile machine, and relates to the image forming apparatus.

Among conventional image forming apparatuses, such as printers, copying machines and facsimile machines, using an electrophotographic type or an electrostatic recording type, there is an image forming apparatus which employs the endless belt for transferring a toner image from an image bearing member onto a transfer material. As the endless belt, there are an intermediary transfer belt for carrying the toner image transferred from the image bearing member and a transfer material conveyance belt for carrying the transfer material onto which the toner image is to be transferred from the image bearing member.

In such an image forming apparatus including the endless belt, there is a need to prevent lateral shift (lateral deviation) of the belt. The lateral shift referred to herein is movement of the belt in a widthwise direction perpendicular to a conveyance direction of the belt. In order to prevent this lateral shift of the belt, in a belt unit and an image forming apparatus including the belt unit which are disclosed in Japanese Laid-Open Patent Application (JP-A) Hei 10-268660 and JP-A Hei 11-20975, a guide member or a rib or the like is provided at end portions of an inner peripheral surface of the endless belt with respect to a widthwise direction. The guide member or the rib is contacted to a preventing member such as a slit-like groove or a roller, whereby the lateral shift of the belt in the widthwise direction is prevented.

However, the lateral shift of the endless belt is prevented by a projection-like guide member or rib provided at the inner peripheral surface of the endless belt and therefore the following problems arose. In a state in which the rib is abutted against the preventing member, a large stress acts on a bonding surface between the rib and the endless belt. When the endless belt is rotated, a place where the rub and an abutment roller contact is changed. Due to the change in stress repeated at this time, there is the case where the endless belt is torn. Specifically, in the neighborhood of the bonding surface between the rib and the endless belt, the tearing of the endless belt occurs. Hereinafter, the tearing of the endless belt is referred to as fatigue fracture. As a result, there is the case where a lifetime of the endless belt is shortened. Particularly, when a resin-based material is used for the endless belt, there is a tendency to easily cause the fatigue fracture.

Further, when an amount of lateral shift (meandering amount) of the endless belt is large, in the case where a flange having an inclined surface is used as the preventing member, the rib can run on the inclined surface of the flange. Particularly, with respect to the endless belt after the rib and the flange slide with each other for a long time, rigidity is lowered at an end portion of the endless belt. When the rigidity at the end portion is lowered, an arrow of run off of the rib when the rib is abutted against the flange is increased, so that a belt lateral shift-preventing force of the rib is weakened. Then, the belt lateral shift-preventing force falls behind an endless belt lateral-shifting force, so that the rib can run on the inclined surface of the flange.

SUMMARY OF THE INVENTION

A principal object is to provide a belt unit capable of preventing lateral shift of an endless belt with respect to a widthwise direction without providing a rib at an inner peripheral surface of the endless belt.

According to an aspect of the present invention, there is provided a belt unit comprising: a rotatable endless belt for receiving a toner image thereon or for conveying a transfer material, wherein the endless belt has a smooth-shaped inner peripheral surface; a first reinforcing member, provided on an outer peripheral surface of the endless belt at one end portion with respect to a belt widthwise direction perpendicular to a movement direction of the endless belt, for reinforcing the endless belt; a second reinforcing member, provided on the outer peripheral surface of the endless belt at the other end portion with respect to the belt widthwise direction perpendicular to the movement direction of the endless belt, for reinforcing the endless belt; and a plurality of supporting members for supporting the inner peripheral surface of the endless belt, wherein in the belt widthwise direction, a length from an inner edge surface of the first reinforcing member to an inner edge surface of the second reinforcing member is smaller than a width of a region in which the supporting members contact the endless belt, and a length from an outer edge surface of the first reinforcing member to an outer edge surface of the second reinforcing member is larger than the width of the region in which the supporting members contact the endless belt.

According to another aspect of the present invention, there is provided an image forming apparatus comprising: a plurality of image bearing members each for bearing a toner image; a rotatable endless belt for receiving a toner image thereon or for conveying a transfer material onto which the toner image is to be transferred, wherein the endless belt has a smooth-shaped inner peripheral surface; a first reinforcing member, provided on an outer peripheral surface of the endless belt at one end portion with respect to a belt widthwise direction perpendicular to a movement direction of the endless belt, for reinforcing the endless belt; a second reinforcing member, provided on the outer peripheral surface of the endless belt at the other end portion with respect to the belt widthwise direction perpendicular to the movement direction of the endless belt, for reinforcing the endless belt; and a plurality of supporting members for supporting the inner peripheral surface of the endless belt, wherein in the belt widthwise direction, a length from an inner edge surface of the first reinforcing member to an inner edge surface of the second reinforcing member is smaller than a width of a region in which the supporting members contact the endless belt, and a length from an outer edge surface of the first reinforcing member to an outer edge surface of the second reinforcing member is larger than the width of the region in which the supporting members contact the endless belt.

According to another aspect of the present invention, there is provided a belt unit comprising: a rotatable endless belt for receiving a toner image thereon or for conveying a transfer material, wherein the endless belt has a smooth-shaped inner peripheral surface; a lateral shift portion for laterally shifting the endless belt toward one end side with respect to a belt widthwise direction perpendicular to a movement direction of the endless belt; a reinforcing member, provided on the outer peripheral surface of the endless belt at the other end side with respect to the belt widthwise direction, for reinforcing the endless belt; and a plurality of supporting members for supporting the inner peripheral surface of the endless belt, wherein the reinforcing member is provided so that a width of region of the inner peripheral surface of the endless belt corresponding to a region in which the reinforcing member is provided on the outer peripheral surface of the endless belt is increased when the endless belt is started to be laterally shifted toward the one end side by rotational movement of the endless belt.

According to a further aspect of the present invention, there is provided an image forming apparatus comprising: a plurality of image bearing members each for bearing a toner image; a rotatable endless belt for receiving a toner image thereon or for conveying a transfer material onto which the toner image is to be transferred, wherein the endless belt has a smooth-shaped inner peripheral surface; a lateral shift portion for laterally shifting the endless belt toward one end side with respect to a belt widthwise direction perpendicular to a movement direction of the endless belt; a reinforcing member, provided on the outer peripheral surface of the endless belt at the other end side with respect to the belt widthwise direction, for reinforcing the endless belt; and a plurality of supporting members for supporting the inner peripheral surface of the endless belt, wherein the reinforcing member is provided so that a width of region of the inner peripheral surface of the endless belt corresponding to a region in which the reinforcing member is provided on the outer peripheral surface of the endless belt is increased when the endless belt is started to be laterally shifted toward the one end side by rotational movement of the endless belt.

These and other objects, features and advantages of the present invention will become more apparent upon a consideration of the following description of the preferred embodiments of the present invention taken in conjunction with the accompanying drawings.

Figure 2:
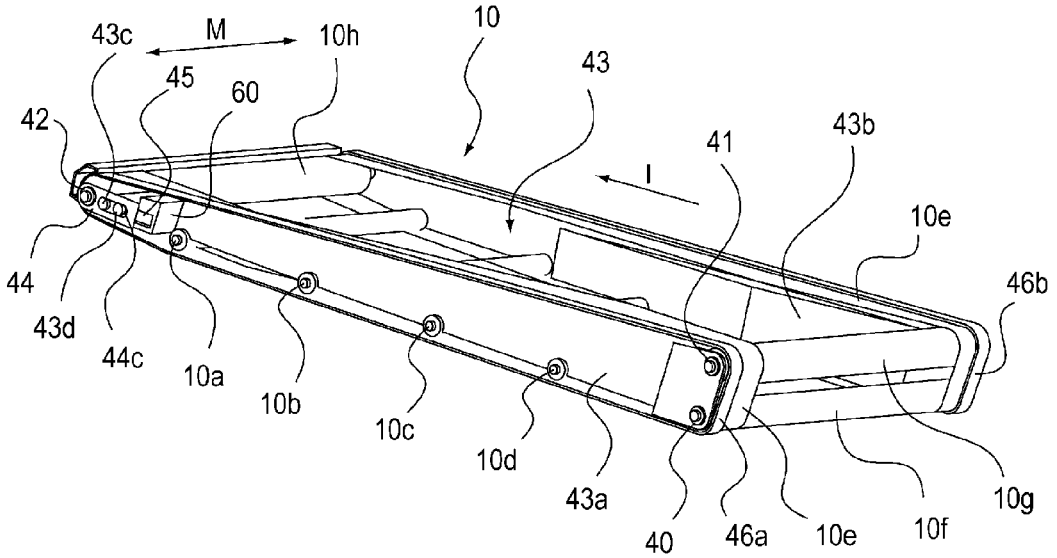
Figure 2:
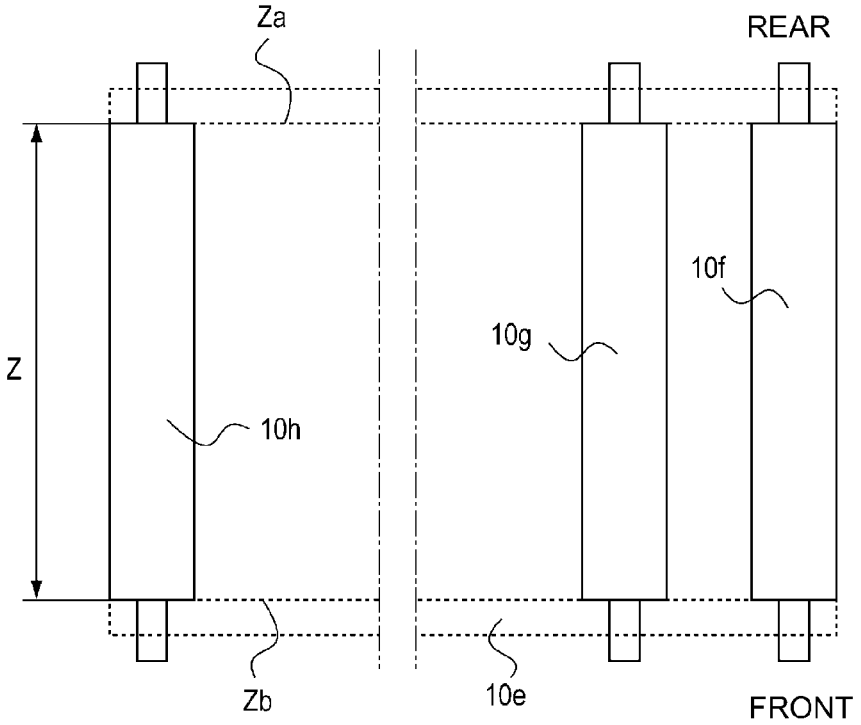

Parts (a) and (b) of FIG. 2 are a schematic partial perspective view of the intermediary transfer unit and a schematic view of the intermediary transfer unit, respectively.

Figure 3:
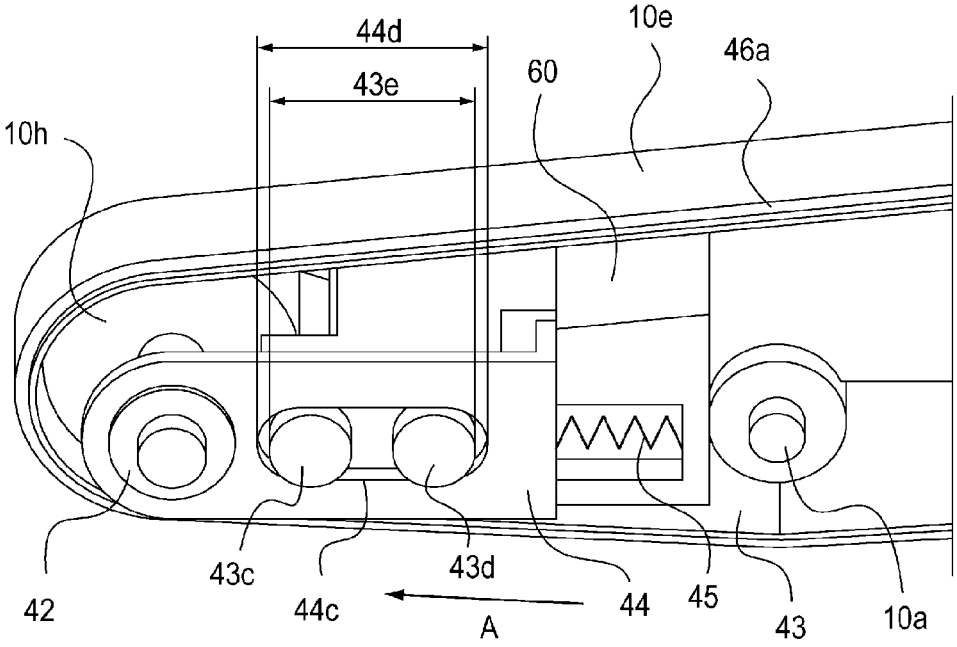

FIG. 3 is a schematic enlarged perspective view of a tension roller supporting portion.

Figure 4:
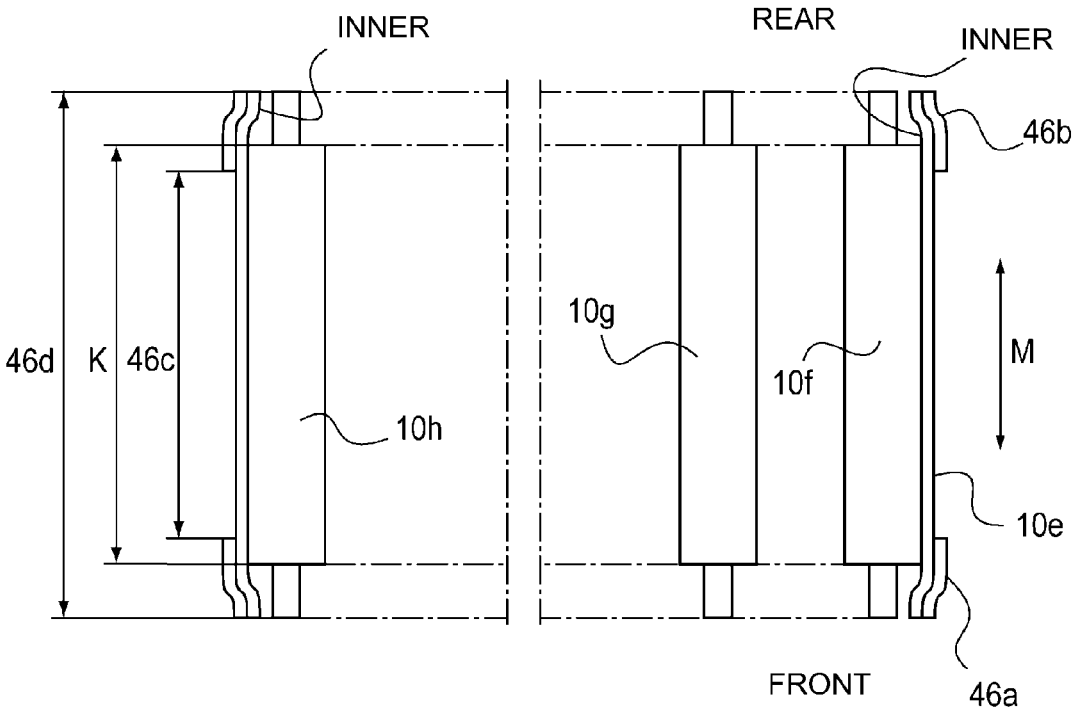

FIG. 4 is a sectional view showing a positional relationship between an intermediary transfer belt and respective rollers.

Figure 5:
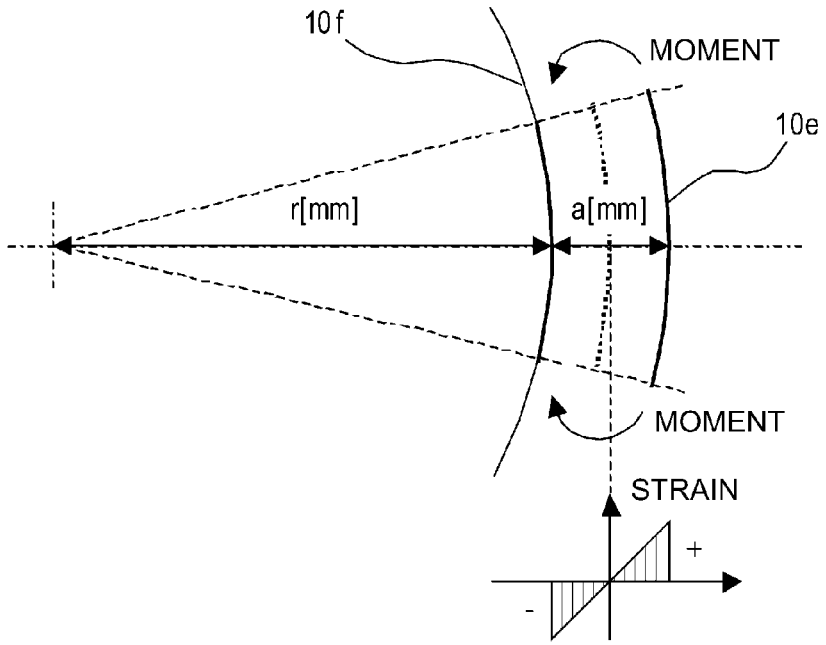
Figure 5:
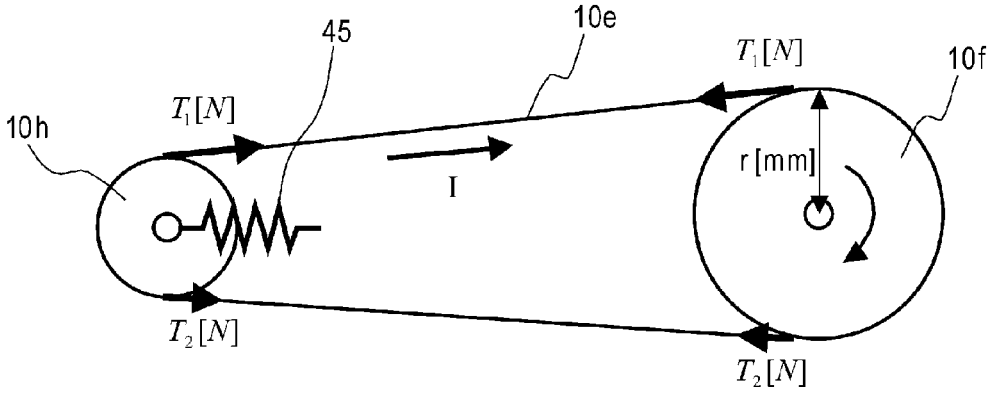

Part (a) of FIG. 5 is an illustration showing a relationship between a neutral surface and strain of the intermediary transfer belt wound about a driving roller, and (b) of FIG. 5 is a schematic view showing a tension state of the driving roller and the intermediary transfer belt.

Figure 6:
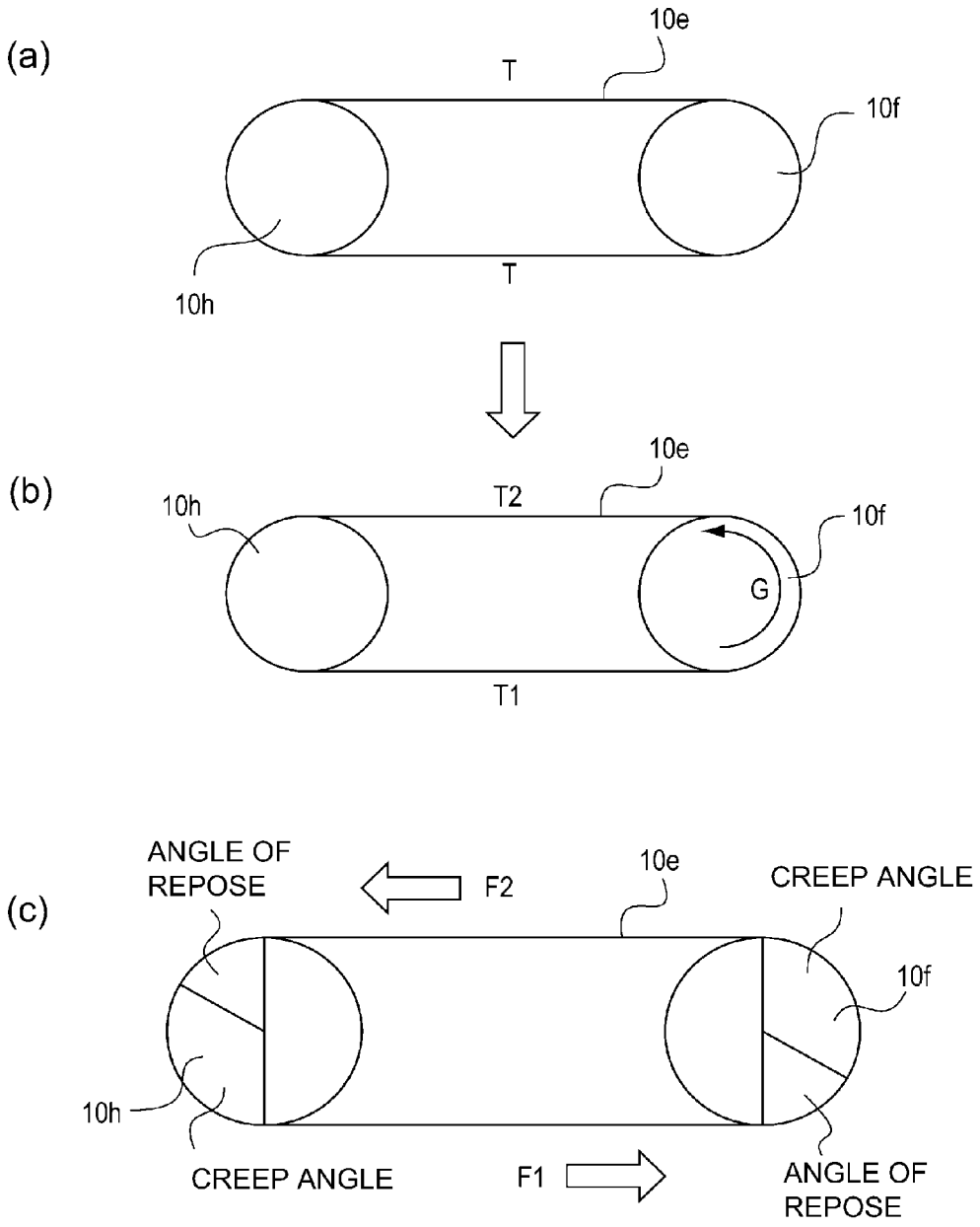

Parts (a) and (b) of FIG. 6 are schematic views each showing a tension state of the belt, and (c) of FIG. 6 in a schematic view showing an angle of repose and a creep angle.

Figure 7:
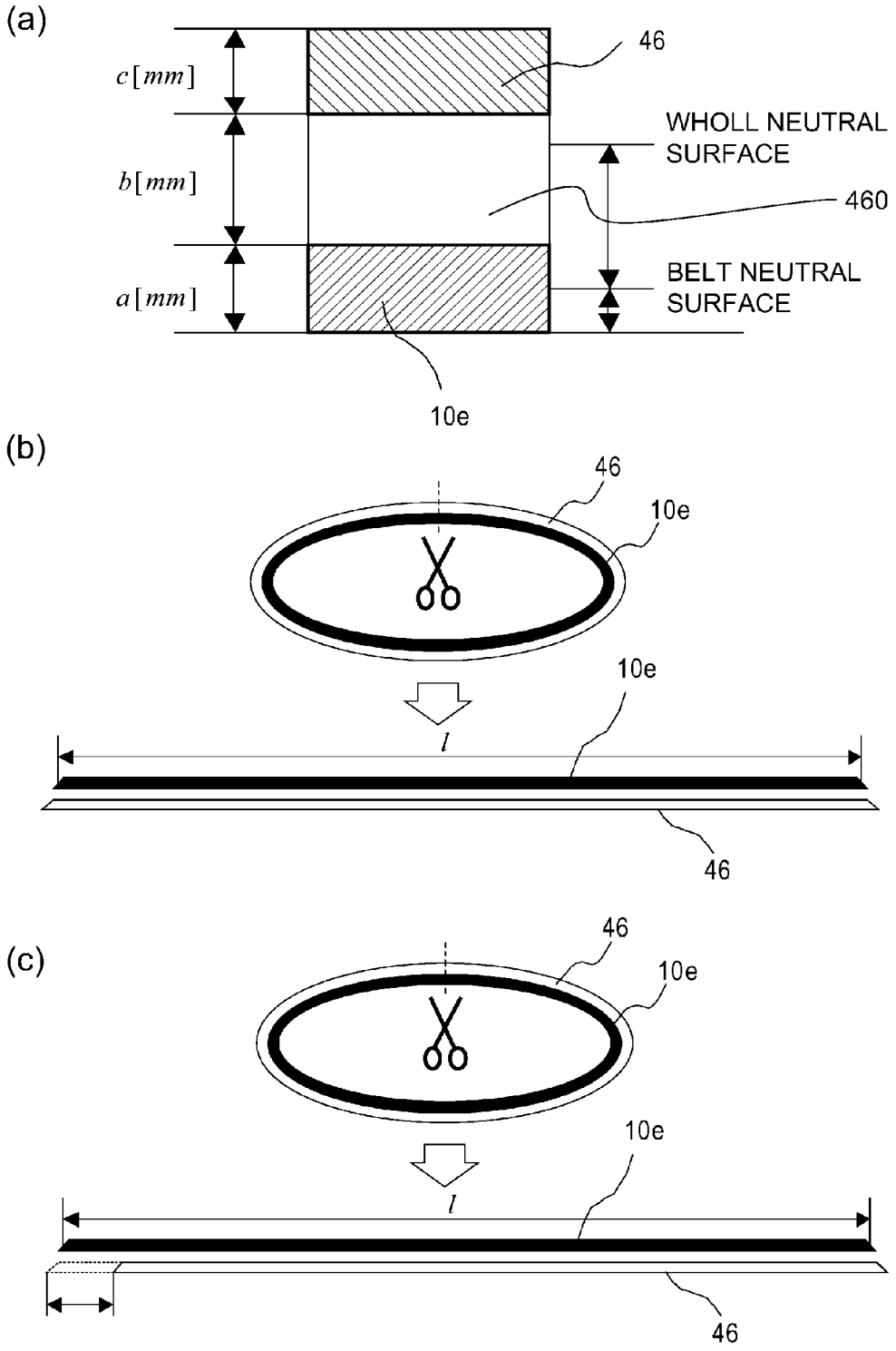

Part (a) of FIG. 7 is a sectional view of the intermediary transfer belt at a portion where a reinforcing member is applied, and (b) and (c) of FIG. 7 are schematic views of the intermediary transfer belt at the portion.

Figure 8:
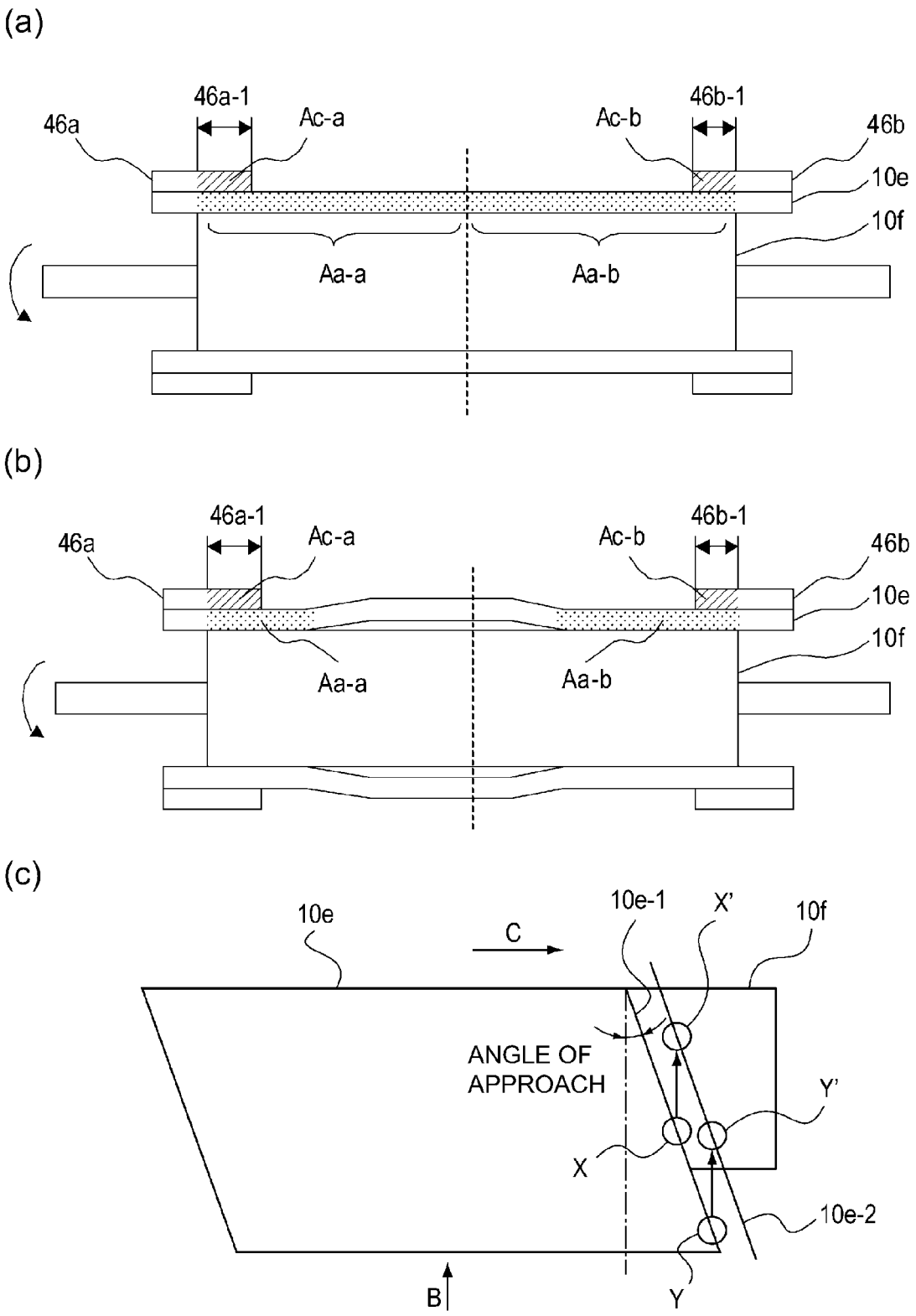

Parts (a) and (b) of FIG. 8 are sectional views of the driving roller as seen from a belt conveyance direction, and (c) of FIG. 8 is a schematic enlarged view of a driving roller end portion.

Figure 9:
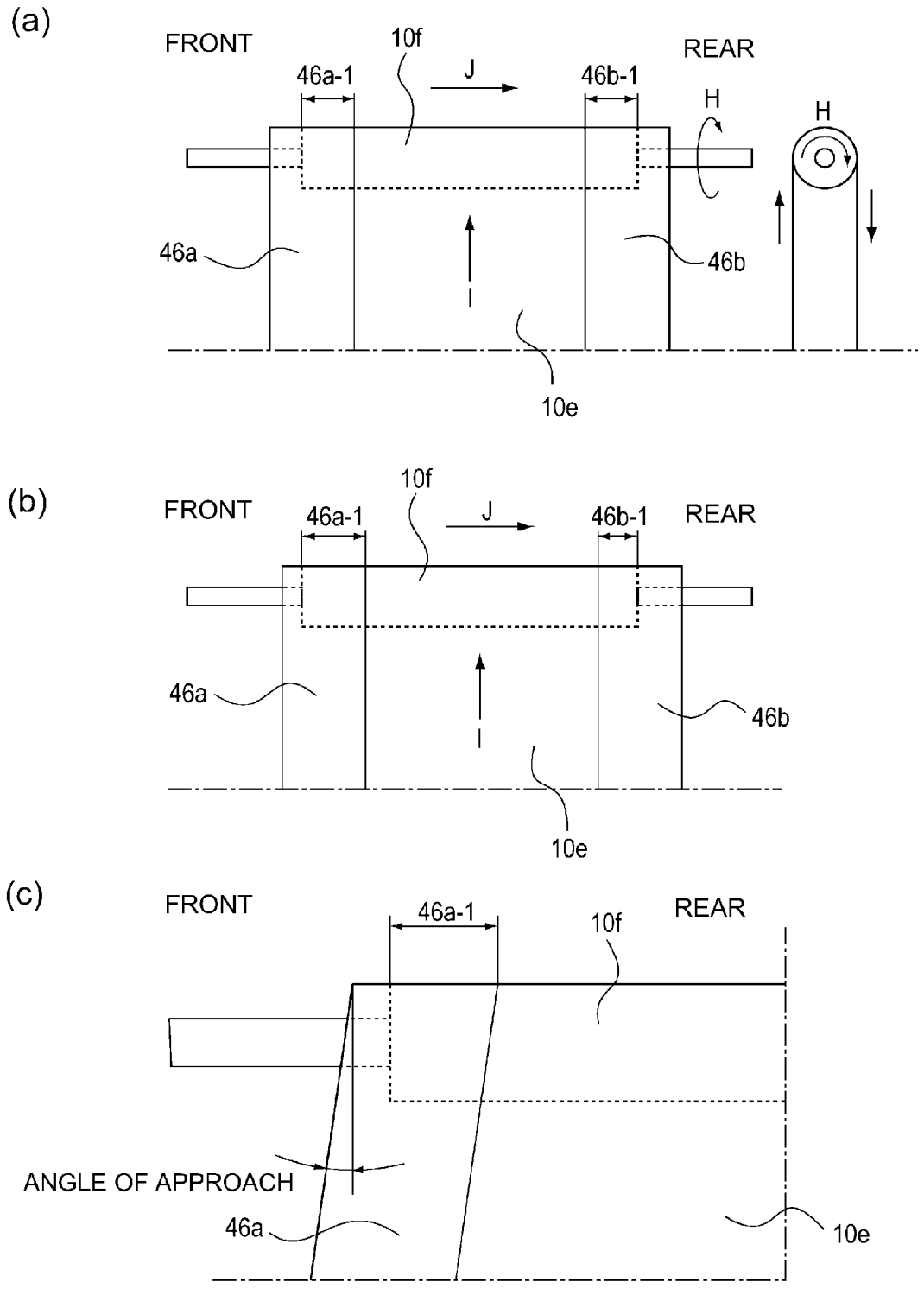

Parts (a), (b) and (c) of FIG. 9 are plan views of the driving roller and the intermediary transfer belt as seen from a top surface side.

Figure 10:
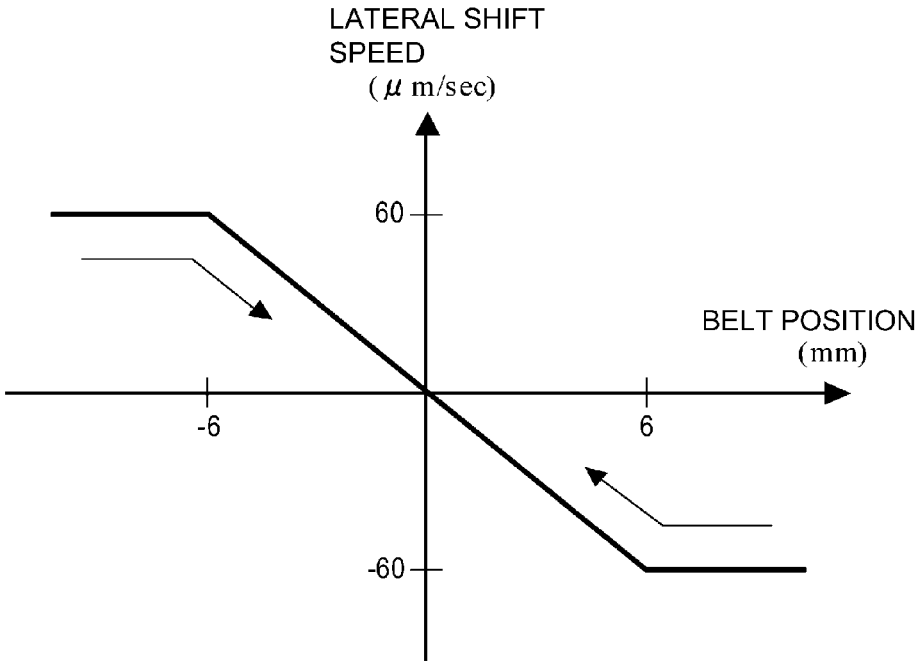

Part (a) of FIG. 10 is a table showing an effect of reinforcing members, and (b) of FIG. 10 is a graph showing a relationship between a belt position and a lateral shift speed.

Figure 11:
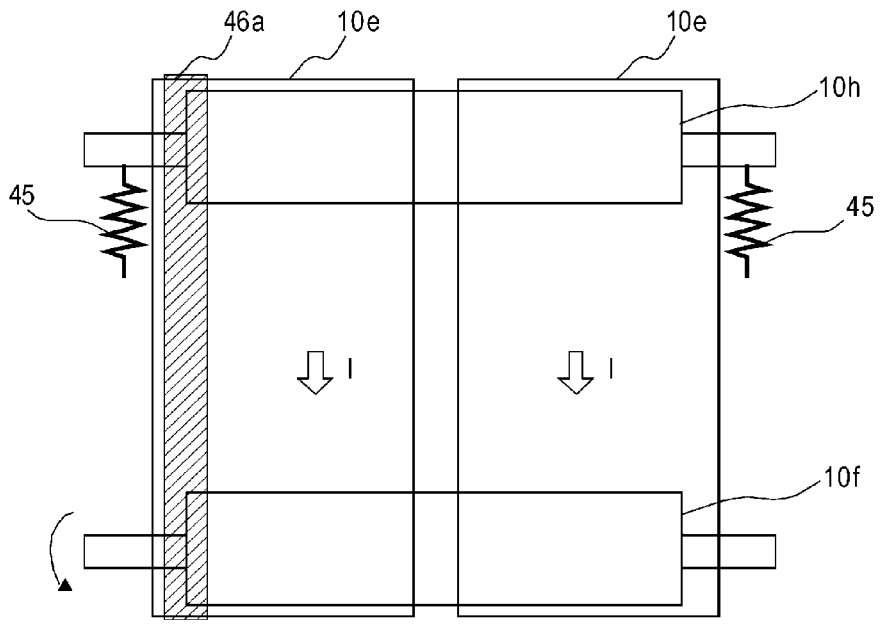
Figure 11:
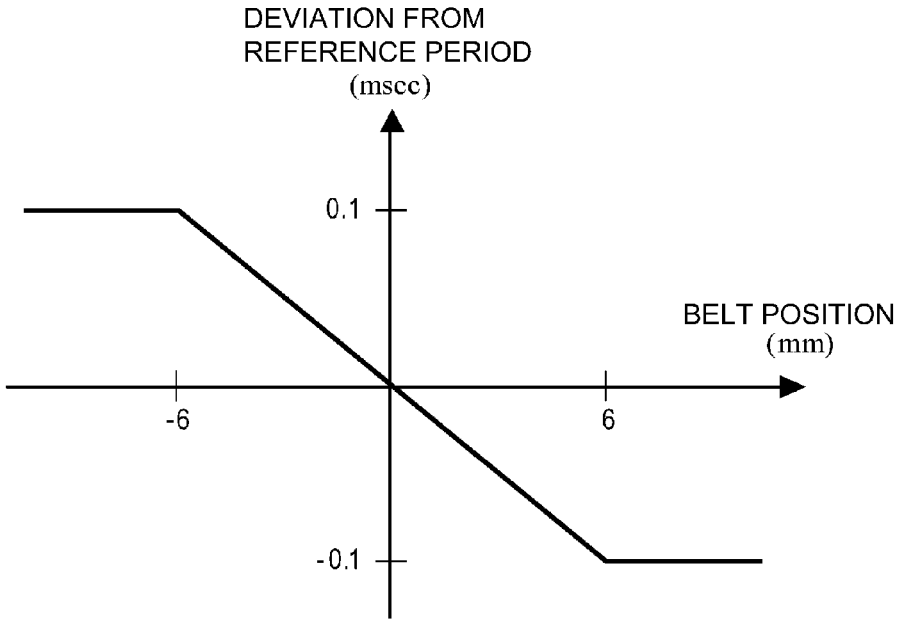

Part (a) of FIG. 11 is a plan view of the intermediary transfer belt when the intermediary transfer belt is cut at a central portion with respect to a belt widthwise direction and is subjected to an experiment, and (b) of FIG. 11 is a graph showing a relationship between the belt position and a deviation from a reference period.

Figure 12:
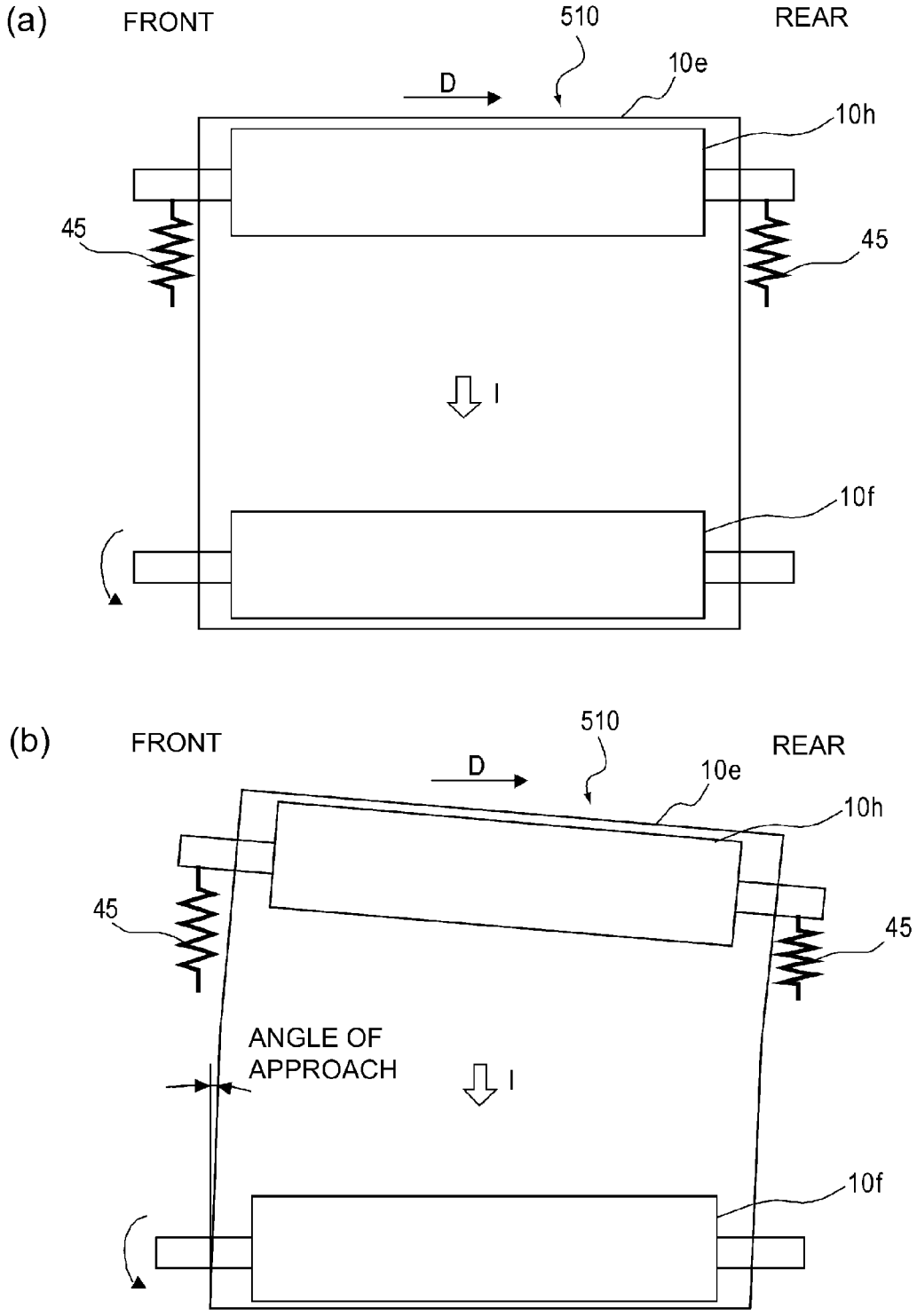

Parts (a) and (b) of FIG. 12 are schematic sectional views of a general intermediary transfer unit as seen from a top surface side.

Figure 13:
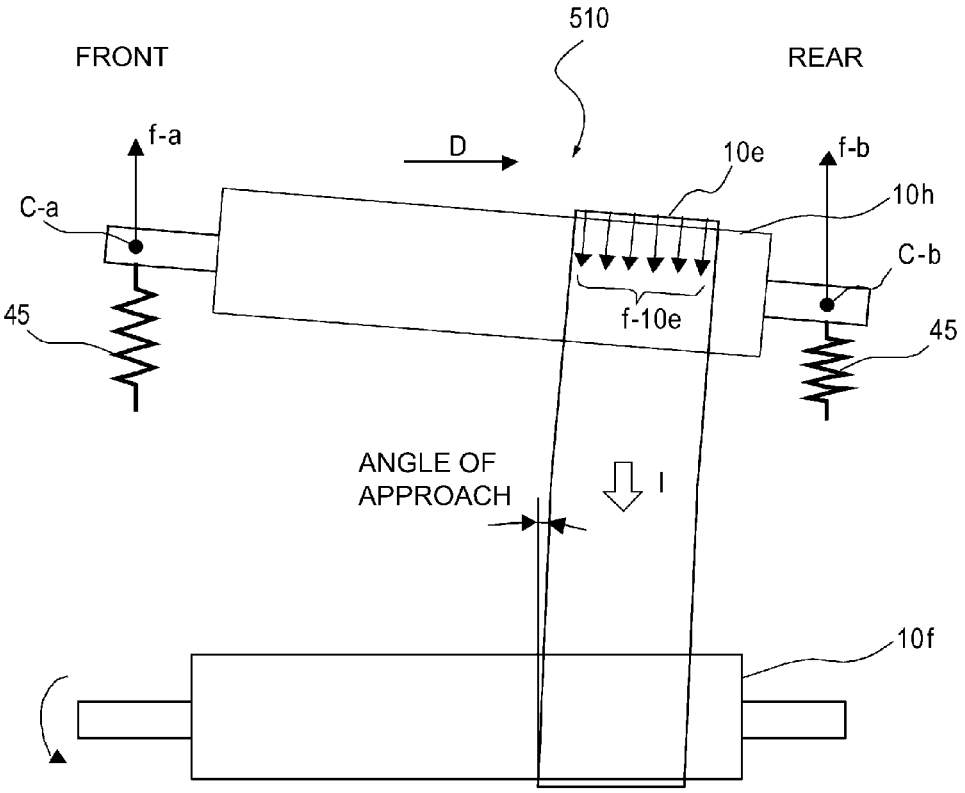

FIG. 13 is a schematic sectional view of the tension roller and the driving roller as seen from a top surface side.

Figure 14:
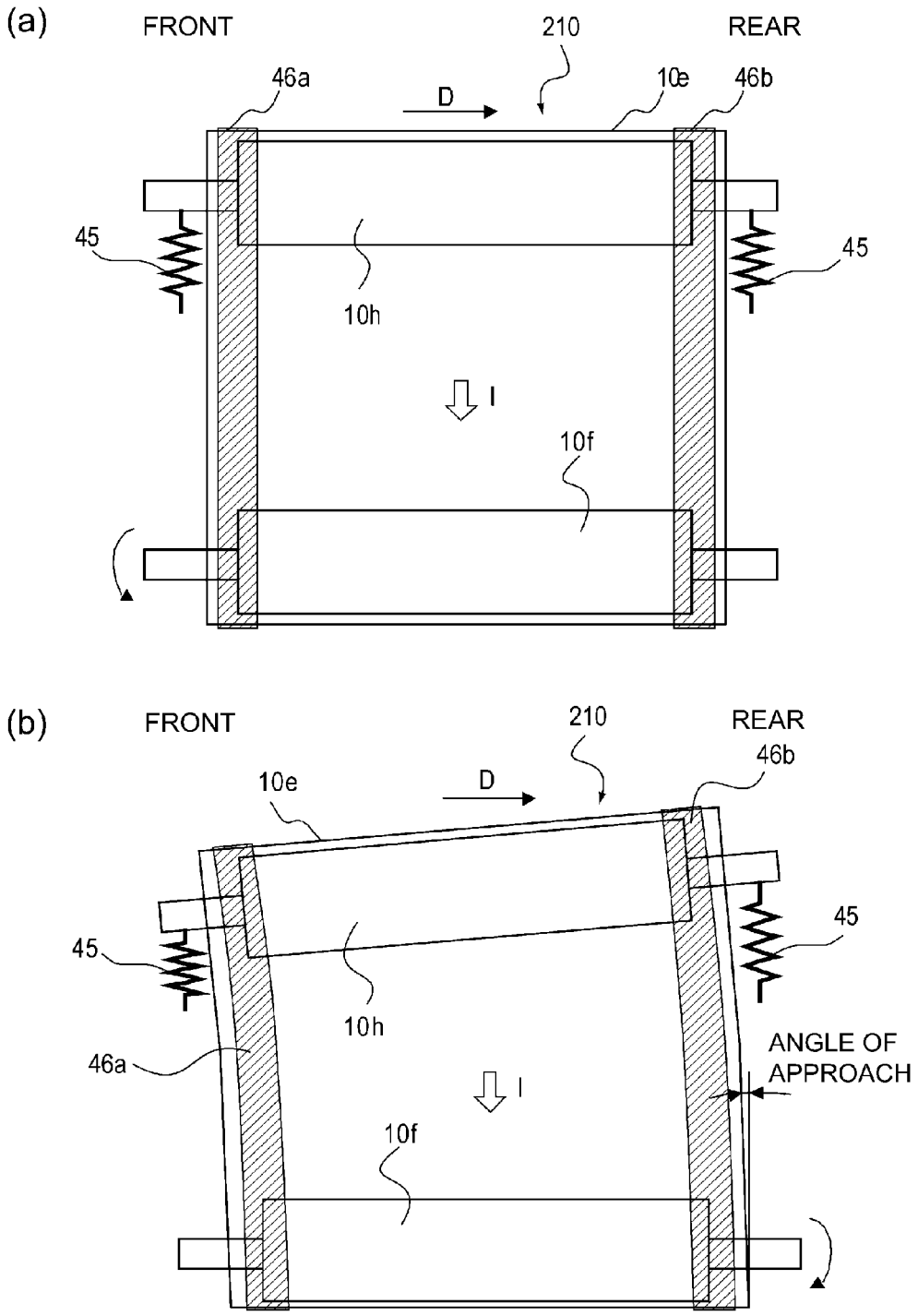

Parts (a) and (b) of FIG. 14 are schematic sectional views of an intermediary transfer unit according to Embodiment 2 of the present invention as seen from a top surface side.

Figure 15:
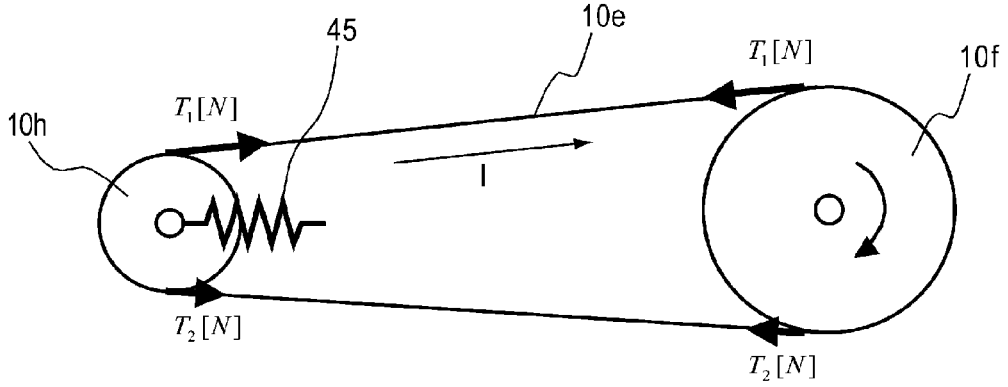
Figure 15:
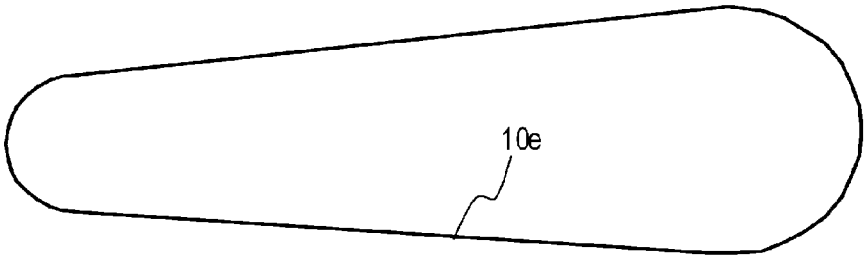
Figure 15:
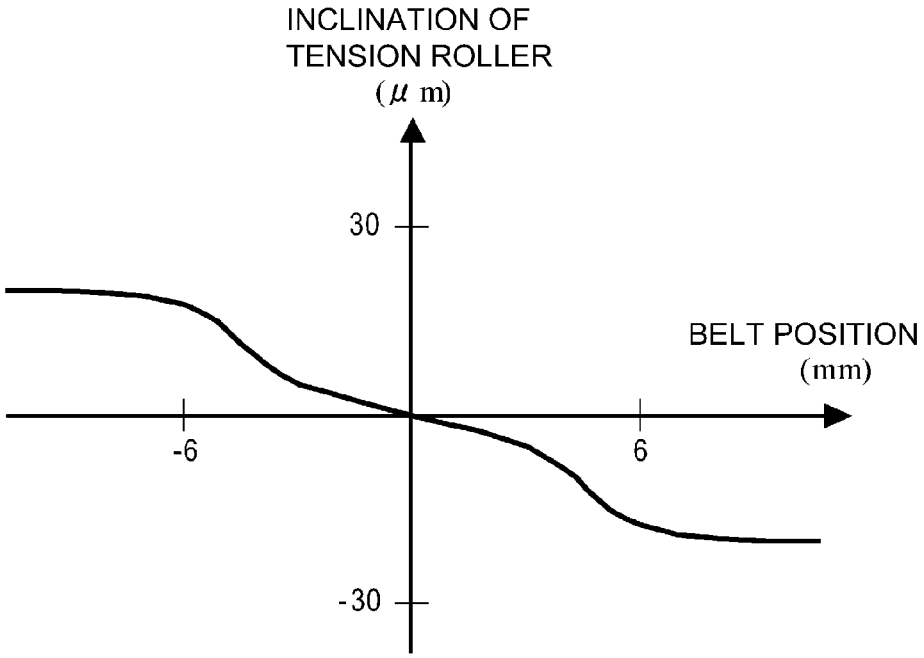

Parts (a) and (b) of FIG. 15 are illustrations of a geometric circumference (perimeter) of the intermediary transfer belt, and (c) of FIG. 15 is a graph showing verification of an effect of the present invention.

Figure 16:
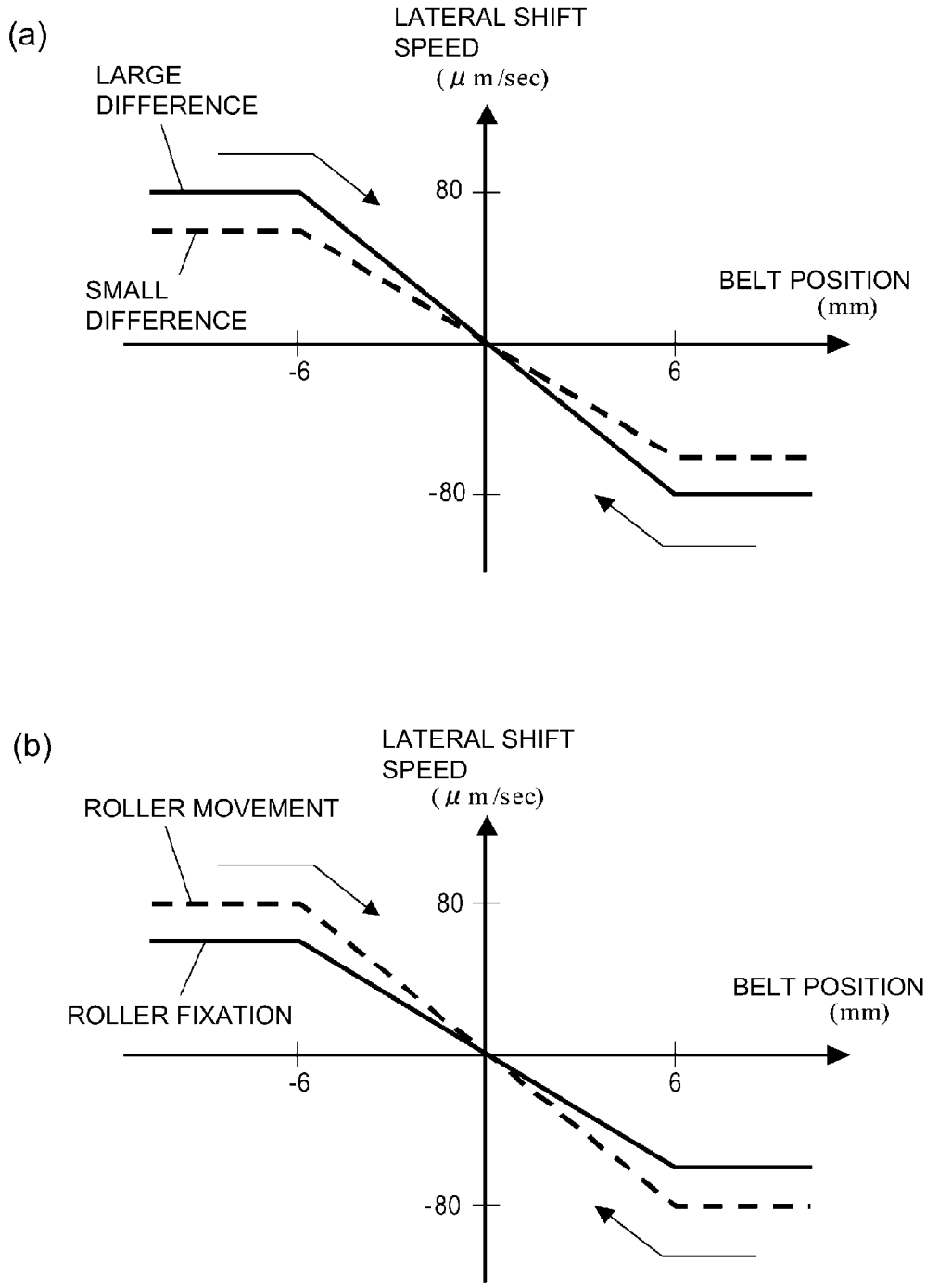

Parts (a) and (b) of FIG. 16 are graphs showing verification of an influence of a difference in inner peripheral length in the present invention.

Figure 17:
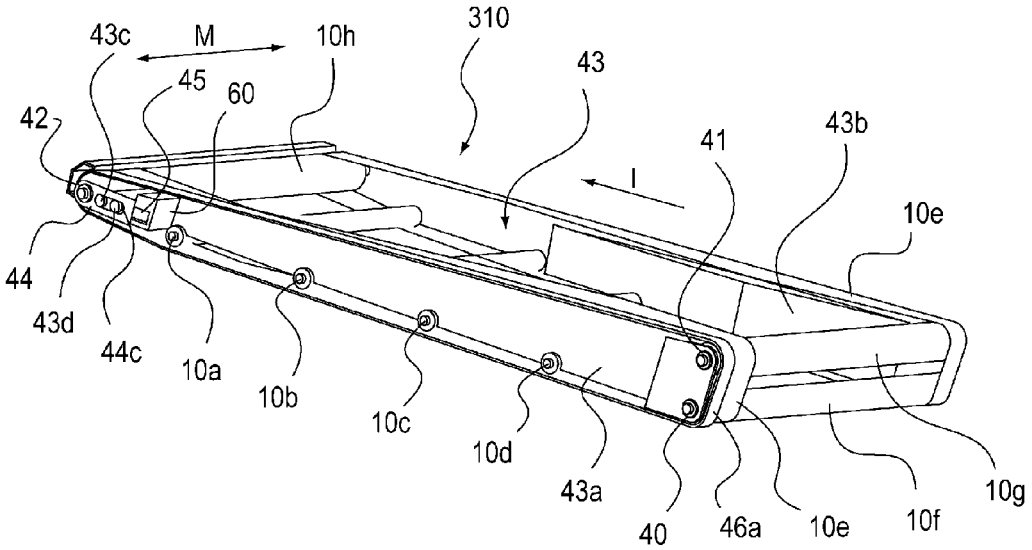
Figure 17:
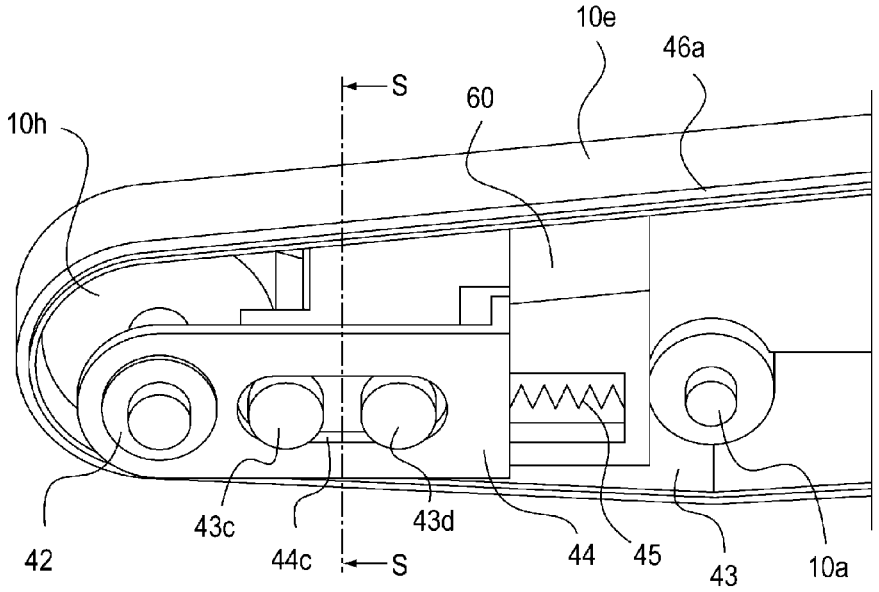

Part (a) of FIG. 17 is a schematic partial perspective view of an intermediary transfer unit in Embodiment 3 of the present invention, and (b) of FIG. 17 is an enlarged partial perspective view of (a) of FIG. 17.

Figure 18:
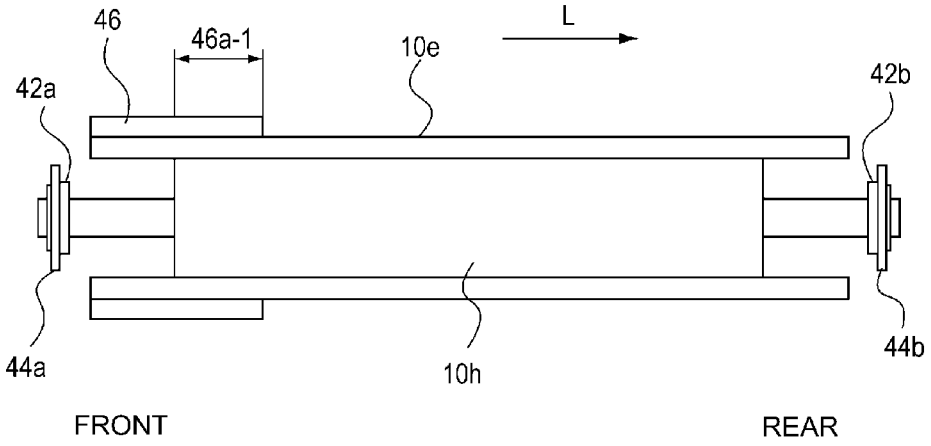
Figure 18:
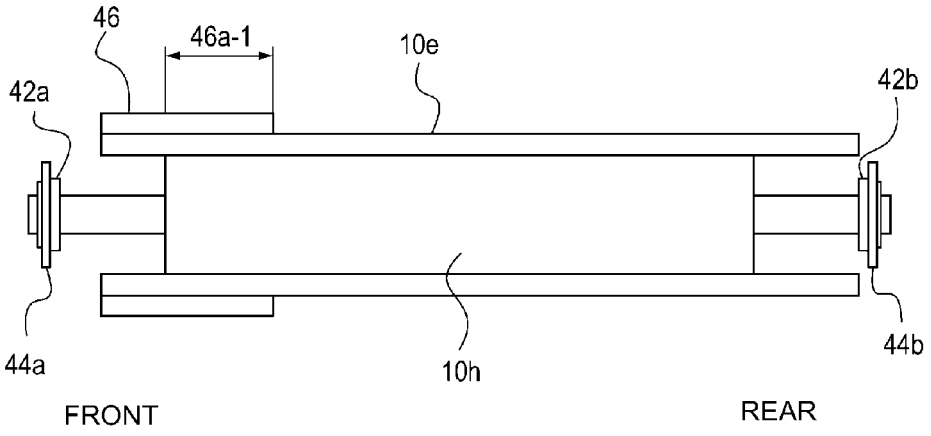

Parts (a) and (b) of FIG. 18 are sectional views of the tension roller as seen from the belt conveyance direction.

DESCRIPTION OF THE PREFERRED EMBODIMENTS

Hereinbelow, with reference to the drawings, preferred embodiments of the present invention will be exemplarily described in detail. However, dimensions, materials, shapes and relative configurations of constituent elements described in the following embodiments should be appropriately changed depending on constitutions and various conditions of belt units or apparatuses to which the present invention is applied. Therefore, unless otherwise noted specifically, the scope of the present invention is not limited to those in the following embodiments.

Embodiment 1

Figure 1:
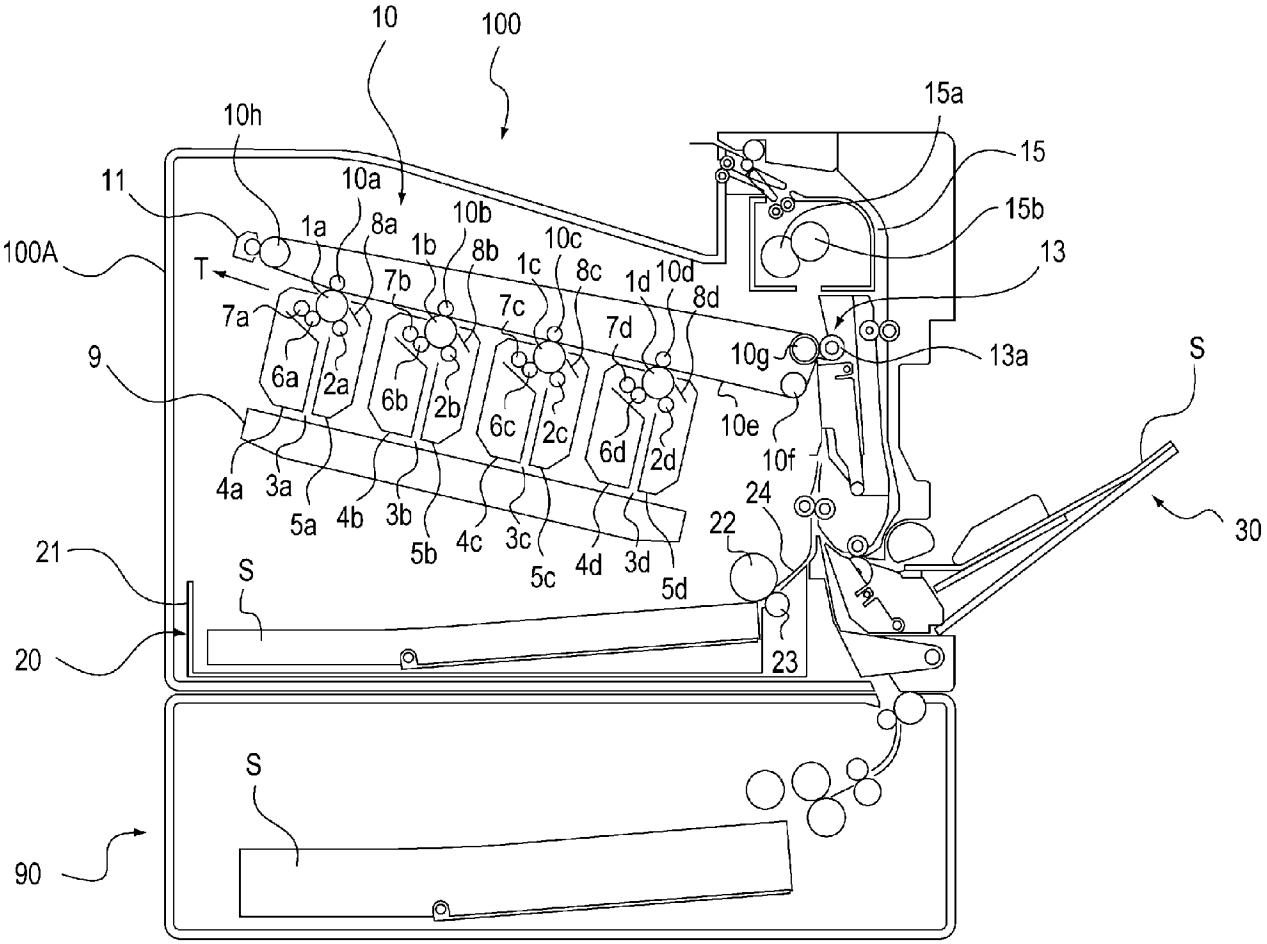
FIG. 1 is a sectional view showing a structure of an image forming apparatus including an intermediary transfer unit according to Embodiment 1 of the present invention.

FIG. 1 is a sectional view showing a structure of an image forming apparatus 100 including an intermediary transfer belt unit (hereinafter referred to as an "intermediary transfer unit 10") according to Embodiment 1 of the present invention. Herein, the image forming apparatus 100 is a color laser beam printer which uses an electrophotographic process and which has a both-side-printing function. As shown in FIG. 1, the image forming apparatus 100 includes an apparatus main assembly 100A in which cartridges 3*a*-3*d* which are image forming means including photosensitive drums 1*a*-1*d* are provided with a detachable constitution. The image forming apparatus 100 has a constitution including an option sheet feeding device (hereinafter referred to as a sheet feeding option portion) 90 under the apparatus main assembly 90.

The cartridges 3*a*-3*d* have the same structure but accommodate toner of different colors, respectively. The cartridges 3*a*-3*d* form toner images of yellow (Y), magenta (M), cyan (C) and black (Bk), respectively. The cartridges 3*a*-3*d* have the same structure and therefore the structure will be described by taking the cartridge 3*a* as a representative example. The cartridge 3*a* includes the photosensitive drum 1*a* which is an image bearing member, a developing unit 4*a* for developing an associated color (yellow) toner image, and a cleaner unit 5*a*. The developing unit 4*a* includes a developing roller 6*a*, a developer applying roller 7*a* and a toner container. Further, the cartridge 3*a* includes a charging roller 2*a*, a cleaning blade 8*a* for the drum and a residual toner container.

Below the cartridges 3*a*-3*d*, a scanner unit 9 is disposed. This scanner unit 9 effects exposure to light on the basis of an image signal with respect to the photosensitive drums 1*a*-1*d*. The photosensitive drums 1*a*-1*d* are charged to a predetermined negative potential by charging rollers 2*a*-2*d* and thereafter electrostatic images (electrostatic latent images) are formed by the scanner unit 9 on the photosensitive drums 1*a*-1*d*, respectively. These electrostatic images are reversely developed by developing units 4*a*-4*d* to deposit negative toners thereon, so that the toner images of Y, M, C and Bk are formed on the photosensitive drums 1*a*-1*d*, respectively.

On the cartridges 3*a*-3*d*, the intermediary transfer unit 10 is disposed. The intermediary transfer unit 10 includes an intermediary transfer belt 10*e* and rollers, for stretching the intermediary transfer belt 10*e*, including a driving roller 10*f*, an opposite roller 10*g* and a tension roller 10*h*. To the intermediary transfer belt 10*e*, a tension T indicated by an arrow in FIG. 1 is applied by the tension roller 10*h*. Further, at opposing positions to the photosensitive drums 1*a*-1*d*, primary transfer rollers 10*a*-10*d* are provided, respectively, inside the intermediary transfer belt 10*e*. The primary transfer rollers 10*a*-10*d* are a primary transfer member to which a transfer voltage is applied by an unshown voltage applying means.

The toner images formed on the photosensitive drums are successively primary-transferred onto the intermediary transfer belt 10*e*. At this time, the respective photosensitive drums 1*a*-1*d* are rotated clockwise. Further, the intermediary transfer belt 10*e* is rotated counterclockwise. On the surface of the intermediary transfer belt 10*e*, the toner images are transferred from the upstream side photosensitive drum 1*a* of the photosensitive drums 1*a*-1*d* with respect to a rotational direction. The transfer of the toner images from the photosensitive drums 1*a*-1*d* onto the intermediary transfer belt 10*e* is made by applying a positive voltage to the primary transfer rollers 10*a*-10*d*. The thus-formed toner images on the intermediary transfer belt 10*e* in a state in which the four color toner images are superposed are moved to a secondary transfer portion 13.

On the other hand, the toners remaining on the surfaces of the photosensitive drums 1*a*-1*d* after the toner images are transferred are removed by cleaning blades 8*a*-8*d*. Further, the toner remaining on the intermediary transfer belt 10*e* after the secondary transfer onto a sheet S is removed by a transfer belt cleaning device 11. The removal toner is passed through a residual toner conveying path (not shown) and is collected in a residual toner collecting container (not shown).

The image forming apparatus 100 includes three sheet feeding devices (sheet feeding portions). First is a main assembly sheet feeding portion 20 disposed inside the apparatus main assembly 100A. Second is a multi-sheet feeding portion 30 disposed at a side surface of the apparatus main assembly 100A. Third is the option sheet feeding device 90 additionally provided under the apparatus main assembly 90.

The first main assembly sheet feeding portion 20 includes a sheet feeding roller 22 for feeding the sheet S from the inside of a sheet feeding cassette 21 in which the sheets S are accommodated and includes a separation roller 23 as a separating means. The sheets S accommodated in the sheet feeding cassette 21 are press-contacted to the sheet feeding roller 22 and then are separated and fed one by one by the separation roller 23. Then, the separates sheet S is conveyed to a registration roller pair 14 via a conveying path 24.

The secondary transfer portion 13 transfers the toner images formed on the intermediary transfer belt 10*e* onto the sheet S. The secondary transfer portion 13 includes a secondary transfer roller 13*a* to which the positive voltage is applied. By applying the positive voltage to the secondary transfer roller 13, onto the sheet S conveyed by the registration roller pair 14, the four color toner images on the intermediary transfer belt 10*e* are secondary-transferred. Above the secondary transfer portion 13, a fixing device 15 including a fixing roller 15*a* and a pressing roller 15*b* is provided. The sheet S on which the toner images are transferred is conveyed into a nip between the fixing roller 15*a* and the pressing roller 15*b* and is heated and pressed by the fixing roller 15*a* and the pressing roller 15*b*, so that the transferred toner images are fixed on the surface of the sheet S.

Next, the intermediary transfer unit 10 according to the present invention will be described in detail with reference to (a) and (b) of FIG. 2. Part (a) of FIG. 2 is a schematic partial perspective view of the intermediary transfer unit 10. Part (b) of FIG. 2 is a schematic view showing a positional relationship among the respective rollers (10*f*, 10*g*, 10*h*). In (a) of FIG. 2, the intermediary transfer unit 10 which is a belt unit includes the intermediary transfer belt 10*e* which has a smooth inner peripheral surface and which is rotatable, and includes a plurality of stretching members for stretching the intermediary transfer belt 10*e*. The stretching members includes the driving roller 10*f* for driving the intermediary transfer belt 10*e*, and stretching surfaces, for stretching the intermediary transfer belt 10*e*, consisting of the tension roller 10*h* and the opposite roller 10*g*.

Further, as shown in (b) of FIG. 2, with respect to a belt widthwise direction M, a contact dimension K (FIG. 4) of a portion where each of the driving roller 10*f*, the opposite roller 10*g* and the tension roller 10*h* stretches the intermediary transfer belt (hereinafter referred to as a "stretching portion Z") is constituted identically. Further, positions of widthwise ends Za and Zb of the stretching portion Z of each roller are uniformized.

As shown in (a) of FIG. 2, the driving roller 10*f*, the opposite roller 10*g* and the tension roller 10*h* are rotatably supported at their widthwise end portions by bearings 40, 41 and 42, respectively. Further, intermediary transfer belt main frames 43*a* and 43*b* (hereinafter referred to as a "main frame 43" support the bearings 40 and 41, and a tension roller supporting side plate (hereinafter referred to as a "supporting side plate 44") supports the bearing 42. Incidentally, to the side plate 43*a* of the main frame 43, a spring fixing portion 60 is provided. At the spring fixing portion 60, one end of a tension roller spring (hereinafter referred to as a "spring 45") is fixed, and this spring 45 is a compression spring and urges the supporting side plate 44 in an urging direction (spring extending direction).

The driving roller 10*f* is a fixed roller supported by the main frame 43 via the bearing 40. To the driving roller 10*f*, a driving force is transmitted from an unshown driving portion of the image forming apparatus 100. The driving roller 10*f* to which the driving force is transmitted is driven and rotated to rotationally move the intermediary transfer belt 10*e*. The surface of the driving roller 10*f* is formed by a rubber layer having high friction coefficient in order to convey the intermediary transfer belt 10*e* with no slide.

The opposite roller 10*g* is a fixed roller supported by the main frame 43 via the bearing 41 and forms a nip with a secondary transfer roller 13*a* in which the toner images are transferred onto the sheet S while the sheet S is nip-conveyed. The opposite roller 10*g* is rotated by drive and conveyance of the intermediary transfer belt 10*e*. The tension roller 10*h* is slidably supported by the main frame 43 together with the supporting side plate 44 via the bearing 42. At both end portions of the intermediary transfer belt 10*e* with respect to the belt widthwise direction M perpendicular an arrow I direction which is the belt rotational direction at the outer peripheral surface of the intermediary transfer belt 10*e*, the reinforcing members 46*a* and 46*b* for reinforcing the both end sides (both end portions) of the intermediary transfer belt 10*e* are provided. The reinforcing members 46*a* and 46*b* are provided so as to extend over one full circumference with a predetermined width at the outer peripheral surface of the intermediary transfer belt 10*e*.

Next, with respect to a sliding operation of the tension roller 10*h* and a constitution for stretching the intermediary transfer belt 10*e*, the description will be made in detail with reference to FIG. 3. FIG. 3 is an enlarged schematic perspective view of a supporting portion for the tension roller 10*h*. In FIG. 3, the supporting side plate 44 is provided with an opening 44*c*. Boss portions 43*c* and 43*d* formed on the main frame 43 are inserted into the opening 44*c*, whereby the supporting side plate 44 is supported by the main frame 43.

An opening width 44*d* of the opening 44*c* is constituted so as to be wider than an outer diameter width 43*e* formed by the boss portions 43*c* and 43*d*. By a difference between the opening width 44*d* and the outer diameter width 43*e*, the supporting side plate is slidably operable. That is, the tension roller 10*h* is slidably operable. The spring 45 urges the supporting side plate 44, i.e., the tension roller 10*h*, in an arrow direction to apply tension to the intermediary transfer belt 10*e*. Then, when the urging force of the spring 45 and the tension of the intermediary transfer belt 10*e* are balanced, the tension roller 10*h* is locked.

However, in Embodiment 1, the tension roller 10*h* may be slidably operable as shown in FIG. 3 and may also be slidably inoperable. In the case where the sliding operation cannot be performed, there is a need to dispose the tension roller 10*h* at a position such that the tension is applied to the intermediary transfer belt 10*e*.

Next, the intermediary transfer belt 10*e* according to the present invention will be described in detail with reference to FIG. 4. FIG. 4 is a sectional view showing a positional relationship between the intermediary transfer belt 10*e* and the respective rollers (10*f*, 10*g*, 10*h*).

A base layer of the intermediary transfer belt 10*e* is formed with a resin-based material having high tensile strength, such as polyimide (PI), polyvinylidene fluoride (PVDF), polyphenylene sulfide (PPS) or polyether ether ketone (PEEK). Thus, the intermediary transfer belt 10*e* is constituted by a resin belt. In many cases, from factors such as molding, strength and ease of deformation, the base layer is formed in a thickness from 50 μm to 100 μm. Further, in order to enhance a transfer efficiency of the toner, the intermediary transfer belt 10*e* having a multi-layer structure in which a coating layer is applied to the rubber layer over the whole outer peripheral surface of the base layer is also present. The intermediary transfer belt 10*e* according to the present invention may also have any of these constitutions.

In FIG. 4, the intermediary transfer belt 10*e* is formed so that its inner peripheral surface has a smooth shape. Here, the "smooth inner peripheral surface" means that the intermediary transfer belt 10*e* does not include a projection-like projected member (guide member or rib) which is projected from the inner peripheral surface in order to prevent lateral shift of the intermediary transfer belt 10*e* in the belt widthwise direction M. At the outer peripheral surface of the intermediary transfer belt 10*e*, the reinforcing members 46*a* and 46*b* are provided over the full circumference of the belt with respect to the belt rotational direction. The reinforcing members 46*a* and 46*b* may only be required to have a width of 2 or 3 mm or more and may have any width so long as a space is ensured. Further, the thickness may also be any value so long as it is 10 microns or more. Further, the widths and thicknesses of the reinforcing members 46*a* and 46*b* may also be different from each other, and the reinforcing members 46*a* and 46*b* are provided by using different materials.

As the reinforcing members 46*a* and 46*b*, the following materials are used. That is, in addition to the resin-based material such as polyester or polyimide, similarly as in the case of the base layer of the intermediary transfer belt 10*e*, a film adhesive tape of polyimide (PI) or the like is used. Further other film adhesive tapes of, in place of polyimide (PI), resin materials such as polyvinylidene fluoride (PVDF), polyphenylene sulfide (PPS) and polyether ether ketone (PEEK) may also be used. Basically, any material may be used so long as the material has sufficient tensile strength. Further, if a material can be molded integrally with the intermediary transfer belt 10*e*, such a material may also be used.

With a higher tensile strength of the reinforcing members 46*a* and 46*b*, a belt lateral shift-preventing effect by the present invention is enhanced. However, the intermediary transfer belt 10*e* is relatively hard, the effect of the present invention is lowered. For that reason, in the case where the tensile strength is low or the case where the material for the intermediary transfer belt 10*e* is very hard, the structure of the reinforcing members 46*a* and 46*b* is formed with a certain width and height. In actuality, the reinforcing members 46*a* and 46*b* are practical when they are formed of a material, having the same Young's modulus as that of the intermediary transfer belt 10*e*, in the thickness from 20 μm to 50 μm with the width of about several mm.

Further, when the reinforcing members 46*a* and 46*b* are provided, the belt lateral shift-preventing effect by the present invention is enhanced in the case where the inner peripheral length of the portion where the reinforcing members 46*a* and 46*b* are provided is, as shown in FIG. 4, made smaller than the inner peripheral length of the portion where the reinforcing members 46*a* and 46*b* are not provided. That is, in this case, the inner peripheral length per unit width of the inner peripheral surface in a region in which the intermediary transfer belt 10*e* is contacted to the rollers (10*f*, 10*h*, 10*g*) is smaller at the portion where the reinforcing members 46*a* and 46*b* are provided than that at the portion where the reinforcing members 46*a* and 46*b* are not provided.

Herein, the inner peripheral length represents an average inner peripheral length (averaged inner peripheral length in the belt widthwise direction M) at each of the portion where the reinforcing members 46*a* and 46*b* are provided and the portion where the reinforcing members 46*a* and 46*b* are not provided. The inner peripheral length does not refer to a partial inner peripheral length due to minute unevenness. These are also true for the description in other embodiments and in the clams described later.

In FIG. 4, the intermediary transfer belt 10*e* and the reinforcing members 46*a* and 46*b* are illustrated in an exaggerated manner for ease of understanding. In actuality, the difference in inner peripheral length between the portion where the reinforcing members 46*a* and 46*b* are provided and the portion where the reinforcing members 46*a* and 46*b* are not provided is very slight. The inner peripheral length difference is not an area to the extent that it can be clearly recognized by eye observation. In the case where the reinforcing members 46*a* and 46*b* are applied to the belt by the adhesive tape, the adhesive tape may preferably be applied while being sufficiently pulled. As the pulling force is strengthened, the inner peripheral length difference becomes large, so that the belt lateral shift-preventing effect in this embodiment is enhanced.

A dimension 46*c* (length) from an inner end (edge) surface of one reinforcing member 46*a* to an inner end surface of the other reinforcing member 46*b* (dimension between the inner end surfaces) with respect to the belt widthwise direction M is smaller than a contact dimension K (length) of a region in which the intermediary transfer belt 10*e* is contacted to the rollers (10*f*, 10*h*, 10*g*). A dimension 46*d* (length) from an outer end (edge) surface of one reinforcing member 46*a* to an outer end surface of the other reinforcing member 46*b* (dimension between the outer end surfaces) with respect to the belt widthwise direction M is larger than the contact dimension K (length) of the region in which the intermediary transfer belt 10*e* is contacted to the rollers (10*f*, 10*h*, 10*g*).

Next, with reference to (a) and (b) of FIG. 5, a rotational movement amount of the intermediary transfer belt 10*e* when the driving roller 10*f* is rotated will be described. Part (a) of FIG. 5 is an illustration showing a relationship between a neutral surface and strain of the intermediary transfer belt 10*e* wound about the driving roller 10*f*, and (b) of FIG. 5 is a schematic view showing a tension state of the driving roller 10*f* and the intermediary transfer belt 10*e*.

Generally, the rotational movement of the intermediary transfer belt 10*e* is determined by the position of the neutral surface of the intermediary transfer belt 10*e*. Even with respect to the driving rollers 10*f* having the same radius. The amount of the rotational movement becomes larger with an increasing thickness of the intermediary transfer belt 10*e* wound about the driving roller 10*f*. In other words, even when the intermediary transfer belts 10*e* have the same length of the inner peripheral surface, if the thickness of the intermediary transfer belt 10*e* is increased, a time required for the intermediary transfer belt 10*e* to rotate one full circumference becomes small. That is, with an increasing thickness of the intermediary transfer belt 10*e*, a period of one rotation (one full circumference) becomes short.

As shown in (a) of FIG. 5, bending of the intermediary transfer belt 10*e* along a curved surface of the driving roller 10*f* by applying bending moment to the intermediary transfer belt 10*e* is considered. At that time, at the inner peripheral surface of the intermediary transfer belt 10*e*, contraction occurs, and at the outer peripheral surface of the intermediary transfer belt 10*e*, expansion occurs. An amount of the strain of the intermediary transfer belt 10*e* is as shown in (a) of FIG. 5. As is understood from (a) of FIG. 5, the strain becomes zero at the neutral surface. That is, the strain amount (elongation amount) represents an average strain amount (elongation amount) of the intermediary transfer belt 10*e*.

This is also true for the case where the intermediary transfer belt 10*e* is bent while being pulled under application of the tension. The strain amount in the case where the intermediary transfer belt 10*e* is straightly pulled without applying moment is equal to the strain amount at the neutral surface when the intermediary transfer belt 10*e* is wound about the driving roller 10*f* while being pulled under the same tension. Further, the relationship such that the intermediary transfer belt 10*e* causes the contraction at the inner peripheral surface and the expansion at the outer peripheral surface. Thus, it is understood that the elongation amount at the neutral surface represents an average elongation amount of the intermediary transfer belt 10*e*.

A state in which the intermediary transfer belt 10*e* is rotationally driven is gradually wound about the driving roller 10*f* will be described in an orderly sequence. First, a straightly moving portion of the intermediary transfer belt 10*e* is bent by the driving roller 10*f*. At that time, the inner peripheral surface of the intermediary transfer belt 10*e* will follow curvature of the roller, thus being contracted. In a state in which the inner peripheral surface is contracted, the driving roller 10*f* and the inner peripheral surface of the intermediary transfer belt 10*e* are contacted. Then, in a state in which the driving roller 10*f* and the inner peripheral surface of the intermediary transfer belt 10*e* are integrated with each other, the intermediary transfer belt 10*e* is moved in accordance with an angle of rotation of the driving roller 10*f*.

At this time, an average movement amount of the intermediary transfer belt 10*e* is the movement amount at the neutral surface. That is, although the driving roller 10*f* and the inner peripheral surface of the intermediary transfer belt 10*e* are integrally moved, the movement amount as a whole is determined by motion at the neutral surface. Therefore, the movement amount of the intermediary transfer belt 10*e* is an amount obtained, in consideration of the strain amount at the neutral surface, by multiplying the radius from the roller center to the neutral surface by the angle of rotation of the driving roller 10*f*.

When the above description is represented by a mathematical expression, a mathematical expression 1 below is obtained.

$$\theta \cdot \frac{1}{1+\frac{T_1}{E_a \cdot A_a}} \cdot \left(r + \frac{a}{2} \cdot \left(1 - \nu_a \cdot \frac{T_1}{E_a \cdot A_a}\right)\right)$$

The angle of rotation of the driving roller 10*f* is θ, the radius of the driving roller 10*f* is r, the thickness of the intermediary transfer belt 10*e* is a, the Young's modulus of the intermediary transfer belt 10*e* is $E_a$, a cross-sectional area of the intermediary transfer belt 10*e* with respect to the belt widthwise direction M is $A_a$, and the poisson ratio is $v_a$. Further, the tension applied to the intermediary transfer belt 10*e* at an upstream side of the driving roller 10*f* is $T_1$, and the tension applied to the intermediary transfer belt 10*e* at a downstream side of the driving roller 10*f* is $T_2$. A relationships between $T_1$ and $T_2$ is shown in (b) of FIG. 5. In (b) of FIG. 5, movement of the intermediary transfer belt 10*e* in the arrow I direction is assumed. The cross-sectional area $A_a$ is not obtained by simply multiplying the dimension of the intermediary transfer belt 10*e* with respect to the belt widthwise direction M by the thickness of the intermediary transfer belt 10*e* but refers to the cross-sectional area of a portion which actually contributes to elastic deformation when the intermediary transfer belt 10*e* is pulled.

Each of terms in the mathematical expression 1 will be described. When the intermediary transfer belt 10*e* is pulled with the tension $T_1$, a unit length of the intermediary transfer belt 10*e* in a circumferential direction is elongated by a mathematical expression 2 below.

$$\frac{T_1}{E_a \cdot A_a}$$

When an amount in which the intermediary transfer belt 10*e* is moved by the roller is considered, a proportion of the movement amount is decreased correspondingly to the amount of elongation. From this fact, it is understood that the term of a mathematical expression 3 below in the mathematical expression 1 takes the influence of the amount of elongation in the movement direction into consideration.

$$\frac{1}{1+\frac{T_1}{E_a \cdot A_a}}$$

Next, the term of a mathematical expression 4 below in the mathematical expression 1 is considered.

$$\left(r+\frac{a}{2}\cdot\left(1-v_a\cdot\frac{T_1}{E_a\cdot A_a}\right)\right)$$

The mathematical expression 4 is a value obtained by adding a distance until the neutral surface to the radius r of the driving roller 10*f*. An original thickness of the intermediary transfer belt 10*e* is a. For that reason, when the tension does not act on the intermediary transfer belt 10*e*, the value obtained by adding the distance until the neutral surface to the radius r is (r+a/2). However, now, a change in thickness by the pulling of the intermediary transfer belt 10*e* by the tension $T_1$ is caused. The poisson ratio is $v_a$ and therefore the thickness is decreased by a mathematical expression 5 below. For that reason, the value obtained by adding the distance until the neutral surface to the radius r is given by the above mathematical expression 4.

$$v_a\cdot\frac{T_1}{E_a\cdot A_a}$$

From the mathematical expression 1, as described above, with a larger thickness, the movement amount of the intermediary transfer belt 10*e* becomes larger. Further, with a stronger tensile strength, i.e., with a larger value of $E_a \times A_a$, the movement amount becomes larger. On the other hand, with a larger value of the tension $T_1$, the movement amount becomes smaller.

Here, with reference to (a) to (c) of FIG. 6, the description for $T_1$ and $T_2$ will be made. The description of (a) to (c) of FIG. 6 is based on the Euler's belt transmission theory. Parts (a) and (b) of FIG. 6 are schematic views each showing the tension state of the belt, and (c) of FIG. 6 is a schematic view showing an angle of repose and a creep angle. Further, here, for simplification of explanation, the opposite roller 10*g* is omitted.

In (a) of FIG. 6, the intermediary transfer belt 10*e* is wound about the driving roller 10*f* and the tension roller 10*h*, so that tensions T are applied. From this state, as shown in (b) of FIG. 6, when the driving roller 10*f* is rotated in an arrow G direction, a difference in tension between an upstream side and downstream side of the driving roller 10*f* is generated. When the upstream-side tension is $T_1$ and the downstream-side tension is $T_2$, a magnitude relationship between these tensions is $T_1>T_2$, so that power of the driving roller 10*f* is transmitted to the tension roller 10*h* by this tension difference. Here, $T_1$ is referred to as a tensile-side tension, and $T_2$ is referred to as a relax-side tension.

Next, with reference to (c) of FIG. 6, a slip phenomenon when the tension difference is generated will be described. In the case where there is the tension difference, there is also a difference in elongation amount of the intermediary transfer belt 10*e* between the tensile side and the relax side. For that reason, when the belt is moved from the tensile side to the relax side, on each of the rollers (10*f*, 10*h*), the expansion and contraction of the intermediary transfer belt 10*e* are generated. In order to expand and contract the intermediary transfer belt 10*e* on each of the rollers (10*f*, 10*h*), slip is inevitably generated. This slip with the elastic deformation is referred to as elastic slip, and a region in which the slip is generated is referred to as the creep angle.

On the other hand, there is a region in which there is no slip between the rollers (10*f*, 10*h*) and the intermediary transfer belt 10*e*, so that this region is referred to as the creep angle. It is generally known that a positional relation between the creep angle and the angle of repose is as shown in (c) of FIG. 6. At this time, at the creep angle on the driving roller 10*f*, the intermediary transfer belt 10*e* is contracted with the movement thereof from the tensile side to the relax side and therefore the intermediary transfer belt 10*e* slips in a position in which it is delayed relative to the rollers (10*f*, 10*h*). On the other hand, at the creep angle on the tension roller 10*h*, the intermediary transfer belt 10*e* is elongated and therefore the intermediary transfer belt 10*e* slips in a direction in which it is advanced relative to the rollers (10*f*, 10*h*), so that a belt speed is increased with the movement of the intermediary transfer belt 10*e* toward the tensile side.

Next, a movement speed of the intermediary transfer belt 10*e* is considered. The movement speed is a value observed when the movement speed is measured at a fixed point by a speed meter or the like of a laser Doppler type. In the fixed point measurement, in a state in which the tension is applied and thus the intermediary transfer belt 10*e* is elongated, a distance per unit time of movement of a certain material point on the intermediary transfer belt 10*e* is observed.

The rotational speed of the driving roller 10*f* is a value obtained by differentiating the angle θ of rotation with respect to the time as shown in a mathematical expression 6 below.

$$\dot{\theta}=\frac{d}{dt}\theta$$

At this time, a conveyance speed of the intermediary transfer belt 10*e* at the upstream side of the driving roller 10*f* to which the tension $T_1$ is applied is given by a mathematical expression 7 below. The mathematical expression 7 is a value obtained by multiplying the rotational speed of the driving roller 10*f* by the radius to the neutral surface.

$$\dot{\theta}\cdot\left(r+\frac{a}{2}\cdot\left(1-v_a\cdot\frac{T_1}{E_a\cdot A_a}\right)\right)$$

Further, the conveyance speed of the intermediary transfer belt 10*e* at the downstream side of the driving roller 10*f* to which the tension $NT_2$ is applied is given by a mathematical expression 8 below.

$$\dot{\theta}\cdot\left(r+\frac{a}{2}\cdot\left(1-v_a\cdot\frac{T_1}{E_a\cdot A_a}\right)\right)\cdot\frac{E_a\cdot A_a+T_2}{E_a\cdot A_a+T_1}$$

The term of a mathematical expression 9 below in the above mathematical expression 8 is obtained by dividing a value of the unit elongation amount at the upstream side of the driving roller 10*f* by a value of the unit elongation amount at the downstream side of the driving roller 10*f*. This is because the movement speed of the intermediary transfer belt 10*e* at the downstream side of the driving roller 10*f* is obtained by the ratio of the downstream-side unit elongation amount to the upstream-side unit elongation amount after all.

$$\frac{E_a \cdot A_a + T_2}{E_a \cdot A_a + T_1}$$

When the fact that the tension $T_1$ at the upstream side of the driving roller 10*f* is larger than the tension $T_2$ at the downstream side of the driving roller 10*f* is considered, from the mathematical expression 9, the movement speed of the intermediary transfer belt 10*e* is inevitably slower at the downstream side than that at the upstream side. With a smaller value of $T_2$ than a value of $T_1$m the movement speed of the intermediary transfer belt 10*e* at the downstream side becomes slower. Further, with a weaker tensile strength, i.e., with a smaller value of $E_a \times A_a$, the movement speed of the intermediary transfer belt 10*e* at the downstream side becomes slower.

As is understood from the mathematical expressions 7 and 8, the movement speed of the intermediary transfer belt 10*e* is different between the upstream side and downstream side of the driving roller 10*f*. However, at the upstream side and the downstream side, the amount of movement of the intermediary transfer belt 10*e* is the same. At the upstream side, the movement speed is fast but the amount of elongation is large. On the other hand, at the downstream side, the movement speed is slow but the amount of elongation is small. For that reason, the movement amount of the intermediary transfer belt 10*e* is not changed. If the movement amount of either one of those at the upstream side and the downstream side is large, when the intermediary transfer belt 10*e* is moved, the difference in movement amount is cumulated, so that a balance of the movement amounts at the upstream portion and the downstream portion is destroyed. Similarly, a rotation period of the intermediary transfer belt 10*e* is also not changed between those at the upstream side and the downstream side.

Next, the rotation period of the intermediary transfer belt 10*e* is considered. When no tension is applied and the elongation amount of the intermediary transfer belt 10*e* is zero, one rotation period is taken as R (sec). When a circumferential (peripheral) length corresponding to one full circumference of the intermediary transfer belt 10*e* at the neutral surface under a no-load state is l, R is given as shown in a mathematical expression 10 below.

$$R = \frac{l}{\dot{\theta} \cdot \left(r + \frac{a}{2}\right)}$$

On the other hand, as shown in (b) of FIG. 5, when the tensions $T_1$ and $T_2$ are applied, the period of one rotation of the belt is as shown in a mathematical expression 11 below. The period is prolonged by an amount corresponding to the amount of elongation of the intermediary transfer belt 10*e*.

$$\frac{l}{\dot{\theta}} \cdot \left(1 + \frac{T_1}{E_a \cdot A_a}\right) \cdot \frac{1}{r + \frac{a}{2} \cdot \left(1 - v_a \cdot \frac{T_1}{E_a \cdot A_a}\right)}$$

At the upstream side of the driving roller 10*f*, the belt having the peripheral length l corresponding to one full circumference at the neutral surface is elongated under application of the tension $T_1$. The mathematical expression 11 is obtained by dividing the length in that state by the speed at the upstream side (mathematical expression 7).

The term of a mathematical expression 12 below in the above mathematical expression 11 is determined in consideration of a change in position of the neutral surface by the pulling of the intermediary transfer belt 10*e* under application of the tension $T_1$ to deform (depress) the intermediary transfer belt 10*e*.

$$\frac{1}{r + \frac{a}{2} \cdot \left(1 - v_a \cdot \frac{T_1}{E_a \cdot A_a}\right)}$$

As described above, the movement arrow, the movement speed and the rotation period of the intermediary transfer belt 10*e* vary depending on the position of the neutral surface, the Young's modulus and the cross-sectional area of the material. In the present invention, by changing the rotation period of the intermediary transfer belt 10*e* by using the reinforcing members 46*a* and 46*b*, the lateral shift of the intermediary transfer belt 10*e* is prevented.

The position of the neutral surface in the case where the reinforcing members 46*a* and 46*b* are applied to the intermediary transfer belt 10*e* will be described with reference to (a) of FIG. 7. Part (a) of FIG. 7 in a sectional view of the intermediary transfer belt at a portion where the reinforcing member 46 is applied to the intermediary transfer belt 10*e*. The thickness of the intermediary transfer belt 10*e* is a, the thickness of the reinforcing member 46 is c, and the thickness of an adhesive 460 at the time when the reinforcing member 46 is applied to the intermediary transfer belt 10*e* is b. Further, the Young's modulus of the intermediary transfer belt 10*e* is $E_a$, the Young's modulus of the reinforcing member 46 is $E_c$, the poisson ratio of the intermediary transfer belt 103 is $v_a$, and the poisson ratio of the reinforcing member 46 is $v_c$. The Young's modulus of the adhesive 460 can be regarded as zero and is not taken into consideration. Further, the cross-sectional area of the intermediary transfer belt 10*e* is $A_a$ and the cross-sectional area of the reinforcing member 46 is $A_c$.

The distance at this time from the inner peripheral surface of the intermediary transfer belt 10*e* to the neutral surface is considered by a mathematical expression 13 below.

$$\frac{a}{2} + \frac{1}{2} \cdot \frac{E_c \cdot A_c(a + 2b + c)}{E_a \cdot A_a + E_c \cdot A_c}$$

Further, the case where the tension $T_1$ is applied to both of the intermediary transfer belt 10*e* and the reinforcing member 46 is considered. At this time, by the tension $T_1$, the intermediary transfer belt 10*e* and the reinforcing member 46 are elongated. By the action, the thickness of the intermediary transfer belt 10*e* and the reinforcing member 46 are decreased. When amounts of the decreases of the thickness are taken into consideration, the distance from the inner peripheral surface to the neutral surface is represented by a mathematical expression 14 below.

$$\frac{a\cdot\left(1-v_a\cdot\frac{T_1}{E_a\cdot A_a+E_c\cdot A_c}\right)}{2}+\frac{1}{2}\cdot\frac{E_c\cdot A_c\left(a\cdot\left(1-v_a\cdot\frac{T_1}{E_a\cdot A_a+E_c\cdot A_c}\right)+2b+c\cdot\left(1-v_c\cdot\frac{T_1}{E_a\cdot A_a+E_c\cdot A_c}\right)\right)}{E_a\cdot A_a+E_c\cdot A_c}$$

As is understood from the mathematical expressions 13 and 14, the distance from the inner peripheral surface to the neutral surface is increased with a larger thickness b of the adhesive 460 and a larger thickness c of the reinforcing member 46. Further, the distance from the inner peripheral surface to the neutral surface is increased with a larger tensile strength $E_c \times A_c$ of the reinforcing member 46.

Further, substitution of the mathematical expression 14 into the mathematical expression 1 yields a mathematical expression 15 below which represents an amount of conveyance of the intermediary transfer belt 10*e* when the reinforcing member 46 is applied to the intermediary transfer belt 10*e*.

$$\dot{\theta}\cdot\frac{1}{\frac{T_1}{E_a\cdot A_a+E_c\cdot A_c}}\cdot\left(r\left|a\cdot\left(1-v_a\cdot\frac{T_1}{\frac{E_a\cdot A_a-E_c\cdot A_c}{2}}\right)\right|\frac{1}{2}\frac{\cdot E_c\cdot A_c\left(a\cdot\left(1-v_a\cdot\frac{T_1}{E_a\cdot A_a\,|\,E_c\cdot A_c}\right)+2b-c\cdot\left(1-v_c\cdot\frac{T_1}{E_a\cdot A_a\,|\,E_c\cdot A_c}\right)\right)}{E_a\cdot A_a+E_c\cdot A_c}\right)$$

Further, the rotation period of the intermediary transfer belt 10*e* will be considered. In the case where the rotation period is considered, there is a need to consider the peripheral length of the intermediary transfer belt 10*e* at the neutral surface. Assuming that the peripheral length at the neutral surface is changed from l to l' by providing the intermediary transfer belt 10*e* with the reinforcing member 46, the rotation period of the intermediary transfer belt 10*e* is represented by a mathematical expression 16 below.

$$\frac{r}{\dot{\theta}}\cdot\left(1+\frac{T_1}{E_a\cdot A_a-E_c\cdot A_c}\right)\cdot\frac{1}{\frac{r\left|\frac{a\cdot\left(1-v_a\cdot\frac{T_1}{E_a\cdot A_a+E_c\cdot A_c}\right)}{2}\right|\frac{1}{2}\cdot E_c\cdot A_c\left(a\cdot\left(1-v_a\cdot\frac{T_1}{E_a\cdot A_a+E_c\cdot A_c}\right)-2b+c\cdot\left(1-v_c\cdot\frac{T_1}{E_a\cdot A_a+E_c\cdot A_c}\right)\right)}{E_a\cdot A_a\,|\,E_c\cdot A_c}}$$

Therefore, the period of one rotation is changed by applying the reinforcing member 46 to the intermediary transfer belt 10*e*. With a higher tensile strength $E_c \times A_c$, the elongation amount of the intermediary transfer belt 10*e* is decreased, so that lengthening of the one rotation period is prevented. Further, the position of the neutral surface is moved, so that the one rotation period is shortened. A degree of the change is determined by a ratio between the tensile strength $E_a \times A_a$ of the intermediary transfer belt 10*e* and the tensile strength $E_c \times A_c$ of the reinforcing member 46. The tensile strength $E_c \times A_c$ of the reinforcing member 46 has to be larger to some extent than the tensile strength $E_a \times A_a$ of the intermediary transfer belt 10*e*.

Here, l and l' will be described with reference to (b) and (c) of FIG. 7. Parts (b) and (c) of FIG. 7 are schematic views each showing a comparison of the peripheral length l of the intermediary transfer belt 10*e* and the peripheral length of the reinforcing member 46 by cutting and developing the intermediary transfer belt 10*e* provided with the reinforcing member 46.

In (b) of FIG. 7, the length of the reinforcing member 46 is slightly larger than the peripheral length l of the intermediary transfer belt 10*e*. In a state the reinforcing member 46 is applied to the intermediary transfer belt 10*e*, the resultant structure is elongated so that the inner peripheral length of the intermediary transfer belt 10*e* is lengthened. For example, when the intermediary transfer belt 10*e* is stretched under high tension and is provided with the reinforcing member 46 in that state, such a state can be creased.

Under such a condition, it is assumed that the peripheral length of at the neutral surface becomes long, so that it is changed from l to l'. At this time, if a mathematical expression 17 below is satisfied, the one rotation period R is no-load state is not changed.

$$\frac{l}{r+\frac{a}{2}}=\frac{l'}{r+\frac{a}{2}+\frac{1}{2}\cdot\frac{E_c\cdot A_c(a+2b+c\cdot)}{E_a\cdot A_a+E_c\cdot A_c}}$$

This is because the peripheral length l' at the position of the neutral surface is lengthened by providing the intermediary transfer belt 10*e* with the reinforcing member 46 but the distance from the center of the driving roller 10*f* to the neutral surface is also lengthened. Amounts of these length and distance are cancelled with each other, so that the one rotation period R in the no-load state is not changed.

Part (c) of FIG. 7 is an illustration of the case where the length of the reinforcing member 46 is smaller than that under the condition of the mathematical expression 17. That is, when the intermediary transfer belt 10*e* is cut and then the length of the reinforcing member 46 in (b) of FIG. 7 and the length of the reinforcing member 46 in (c) of FIG. 7 are compared, the length of the reinforcing member 46 in (c) of FIG. 7 is smaller than that in (b) of FIG. 7. That is, a relationship of a mathematical expression 18 below is satisfied.

$$\frac{l}{r+\frac{a}{2}}>\frac{l'}{r+\frac{a}{2}+\frac{1}{2}\cdot\frac{E_c\cdot A_c(a+2b+c\cdot)}{E_a\cdot A_a+E_c\cdot A_c}}$$

In (c) of FIG. 17, the reinforcing member 46 is provided so that the inner peripheral length at the portion where the reinforcing member 46 is provided as shown in FIG. 4. In the state in (c) of FIG. 7, when the peripheral length at the neutral surface is changed from l to l', the one rotation period R in the no-load state becomes short (small).

Further, in the case where the reinforcing member 46 is provided as shown in (c) of FIG. 7, when the peripheral length l' at the neutral surface is finely observed with respect to the belt widthwise direction M, the value of l' is continuously changed between the portion where the reinforcing member 46 is provided and the portion where the reinforcing member 46 is not provided. At that time, as represented by the mathematical expression 13, the position of the neutral surface is also changed but amounts of the changes of the length and the position cannot be canceled with each other. For that reason, when the peripheral length l' is finely observed with respect to the belt widthwise direction M, the value of the one rotation period R in the no-load state is continuously changed. At that time, R at the portion where the reinforcing member 46 is provided is small.

Further, the cross-sectional area $A_a$ of the intermediary transfer belt 10*e* and the cross-sectional area $A_c$ of the reinforcing member 46 will be described specifically with reference to (a) and (b) of FIG. 8. The cross-sectional area $A_a$ is not the value obtained by simply multiplying the dimension of the intermediary transfer belt 10*e* with respect to the belt widthwise direction M by the thickness of the intermediary transfer belt 10*e* but refers to the cross-sectional area at a portion which is actually associated with the elastic deformation when the intermediary transfer belt 10*e* is pulled.

Part (a) of FIG. 8 is a sectional view of the driving roller 10*f* as seen from the belt conveyance direction, and shows a state in which the intermediary transfer belt 10*e* is contacted to the driving roller 10*f* in a stretched state under application of the tension. In this state, the portion where the intermediary transfer belt 10*e* is disengaged (detached) from the driving roller 10*f* does not relate to the elastic deformation when the intermediary transfer belt 10*e* is pulled. That is, the portion represented by dots in (a) of FIG. 8 is the cross-sectional area $A_a$ of the intermediary transfer belt 10*e*. Further, a hatched portion represents the cross-sectional area $A_c$ of each of the reinforcing members 46*a* and 46*b*.

In the following, for convenience of explanation of an operation principle in this embodiment, the cross-sectional areas $A_a$ and $A_c$ which relate to the reinforcing members 46*a* and 46*b* are considered by dividing the driving roller 10*f* into two sections at the center of the driving roller 10*f*. The cross-sectional areas relating to the reinforcing member 46*a* are the cross-sectional area $A_{a-a}$ of the dotted portion and the cross-sectional area $A_{c-a}$ of the hatched portion at the left side of (a) of FIG. 8. The cross-sectional areas relating to the reinforcing member 46*b* are the cross-sectional area $A_{a-b}$ of the dotted portion and the cross-sectional area $A_{c-b}$ of the hatched portion at the right side of (a) of FIG. 8.

Part (b) of FIG. 8 is a sectional view of the driving roller 10*f* as seen from the belt conveyance direction. However, the intermediary transfer belt 10*e* in (b) of FIG. 8 is somewhat shifted rightward relative to the driving roller 10*f*. Here, in (b) of FIG. 8, the case where the inner peripheral surface difference of the intermediary transfer belt 10*e* is large as shown in FIG. 4 is illustrated exaggeratedly. In actually, the central portion of the intermediary transfer belt 10*e* is completely spaced from the driving roller 10*f* but is in a state in which it is contacted to the driving roller 10*f*. In the state of (b) of FIG. 8, a reaction force generated by the contact of the driving roller 10*f* and the intermediary transfer belt 10*e* is only small.

In (b) of FIG. 8, due to the difference in inner peripheral length difference, only the portion of the intermediary transfer belt 10*e* in the neighborhood of the reinforcing members 46*a* and 46*b* having the small inner peripheral surface relates to the elastic deformation when the intermediary transfer belt 10*e* is pulled. At this time, only the dotted portions in (b) of FIG. 8 represent the cross-sectional areas $A_{a-a}$ and $A_{a-b}$ of the intermediary transfer belt 10*e*. Further, The cross-sectional areas relating to the reinforcing member 46*a* are the cross-sectional area $A_{a-a}$ of the dotted portion and the cross-sectional area $A_{c-a}$ of the hatched portion at the left side of (b) of FIG. 8. Further, the cross-sectional areas relating to the reinforcing member 46*b* are the cross-sectional area $A_{a-b}$ of the dotted portion and the cross-sectional area $A_{c-b}$ of the hatched portion at the right side of (b) of FIG. 8.

In (b) of FIG. 8, the intermediary transfer belt 10*e* is somewhat shifted rightward relative to the driving roller 10*f*. For that reason, the left-side cross-sectional area $A_{c-a}$ relating to the reinforcing member 46*a* is larger than the right-side cross-sectional area $A_{c-b}$ relating to the reinforcing member 46*b*, so that the left-side tensile strength is stronger than the right-side tensile strength. Correspondingly to the difference of the left-side tensile strength from the right-side tensile strength, the elongation amounts of the left-side intermediary transfer belt 10*e* and the reinforcing member 46*b* become small, so that the left-side cross-sectional area $A_{a-a}$ of the intermediary transfer belt 10*e* also becomes small correspondingly to the decrease in elongation amount. On the other hand, the right-side cross-sectional area $A_{c-a}$ is weak in tensile strength. Correspondingly to the difference of the right-side tensile strength from the left-side tensile strength, the elongation amounts of the right-side intermediary transfer belt 10*e* and the reinforcing member 46*b* become large, so that the right-side cross-sectional area $A_{a-b}$ of the intermediary transfer belt 10*e* also becomes large correspondingly to the increase in elongation amount. Therefore, the left-side cross-sectional area $A_{a-a}$ relating to the reinforcing member 46*a* is smaller than the right-side cross-sectional area $A_{a-b}$ relating to the reinforcing member 46*b*.

Thus, in the case where the inner peripheral length difference of the intermediary transfer belt 10*e* is large as shown in FIG. 4, by the lateral shift of the intermediary transfer belt 10*e*, in addition to the changes of the cross-sectional areas $A_{c-a}$ and $A_{c-b}$ of the reinforcing members 46*a* and 46*b*, the cross-sectional areas $A_{a-a}$ and $A_{a-b}$ of the intermediary transfer belt 10*e* are also changed. Correspondingly to the changes of the cross-sectional areas $A_{a-a}$ and $A_{a-b}$ of the intermediary transfer belt 10*e*, a change rate of the tensile strength ($E_a \times A_a + E_c \times A_c$) is also increased. Therefore, from the mathematical expression 16, a proportion of the change in rotation period becomes large when the inner peripheral length difference is large.

Next, a mechanism of the belt lateral shift of the intermediary transfer belt 10*e* according to the present invention will be specifically described with reference to (c) of FIG. 8 by illustrating the driving roller 10*f* and the intermediary transfer belt 10*e*. Part (c) of FIG. 8 is a schematic enlarged view of a driving roller end portion showing a state in which the intermediary transfer belt 10*e* is wound about the driving roller 10*f*.

When the intermediary transfer belt 10*e* is wound straightly about the driving roller 10*f*, i.e., wound about the driving roller 10*f* perpendicularly to an axis of the driving roller 10*f*, the position of the intermediary transfer belt 10*e* is not changed between an entrance side where the intermediary transfer belt 10*e* is wound about the driving roller 10*f* and an exit side where the intermediary transfer belt 10*e* is fed from the driving roller 10*f*. Therefore, the intermediary transfer belt 10*e* is driven and conveyed continuously at the same position and thus the lateral shift of the belt is not generated.

However, it is impossible to completely eliminate various variation factors such as the tension difference between before and after the spring 45, misalignment of the driving roller 10*f*, the opposite roller 10*g* and the tension roller 10*h*, and a variation of dimension of parts constituting the mechanism. It is impossible to completely eliminate the variation factors and therefore the intermediary transfer belt 10*e* is always wound about the driving roller 10*f* with a predetermined angle (hereinafter referred to as an angle of approach). Then, the intermediary transfer belt 10*e* is shifted in a direction along the angle of approach.

In this embodiment, in order to prevent the generation of the lateral shift of the belt, bearings are constituted so that the axes of the driving roller 10*f*, the opposite roller 10*g* and the tension roller 10*h* retain a parallel state. Further, in order to prevent the generation of the lateral shift of the belt, the driving roller 10*f*, the opposite roller 10*g* and the tension roller 10*h* have the same rotational speed during the rotational movement of the intermediary transfer belt.

In (c) of FIG. 8, the intermediary transfer belt 10*e* is driven and conveyed in an arrow B direction, thus being wound about the driving roller 10*f*. A point X on an edge line 10*e*-1 of the intermediary transfer belt 10*e* is gradually moved to a position of a point X' as the intermediary transfer belt 10*e* is wound about the driving roller 10*f*. Another point Y is gradually moved to a position of a point Y' as the intermediary transfer belt 10*e* is wound about the driving roller 10*f*. The edge line 10*e*-1 of the intermediary transfer belt 10*e* is gradually moved to a position of a line 10*e*-2 connecting the points X' and Y' as the intermediary transfer belt 10*e* is wound about the driving roller 10*f*. By this continuous movement, the intermediary transfer belt 10*e* is gradually shifted in an arrow C direction shown in (c) of FIG. 8 with the angle of approach. The above is the mechanism of the belt lateral shift.

Next, a mechanism for preventing the belt lateral shift of the intermediary transfer belt 10*a* according to the present invention will be specifically described with reference to (a), (b) and (c) of FIG. 9. Parts (a) to (c) of FIG. 9 are back-side views of the driving roller 10*f* and the intermediary transfer belt 10*e* as seen from a lower surface side.

In (a) of FIG. 9, the positional relationship between the unshown tension roller 10*h* and the intermediary transfer belt 10*e* is a left-right (bilateral) symmetrical system. However, the left-right symmetrical system refers to a design reference position, and variations of parts and assembling are not taken into consideration. When the driving roller 10*f* is driven and rotated in an arrow H direction, the intermediary transfer belt 10*e* is driven and conveyed in an arrow I direction. When the intermediary transfer belt 10*e* is driven and conveyed, the intermediary transfer belt 10*e* is started to be shifted along the angle of approach formed due to the variations of the parts and the assembling. In this embodiment, the case where the intermediary transfer belt 10*e* is shifted in an arrow J direction is shown as an example.

When the intermediary transfer belt 10*e* is in the positional relationship of (b) of FIG. 9 by the movement in the arrow J direction, an overlapping region 46*a*-1 where the apparatus front-side reinforcing member 46*a* overlaps with the driving roller 10*f* is increased, and an overlapping region 46*b*-1 where the apparatus rear-side reinforcing member 46*b* overlaps with the driving roller 10*f* is decreased.

When the reinforcing member 46*b* is provided at a second reinforcing member side, the reinforcing member 46*a* is provided at a first reinforcing member side. The lateral shift in the arrow J direction can be expressed as the lateral shift toward the second reinforcing member side.

In this case, in accordance with the mathematical expression 16, how the one rotation periods of the apparatus front-side reinforcing member 46*a* and the apparatus rear-side reinforcing member 46*b* are changed will be considered. First, the apparatus front-side reinforcing member 46*a* is noted. When the intermediary transfer belt 10*e* is laterally shifted to increase the overlapping region 46*a*-1, the cross-sectional area $A_c$ is increased. Thus, the total tensile strength of the intermediary transfer belt 10*e* and the reinforcing member 46*a*, i.e., $E_a \times A_a + E_c \times A_c$ is also increased. The neutral surface at the apparatus front-side reinforcing member 46*a* is moved to a position remote from the center axis (shaft) of the driving roller 10*f*.

Further, the elongation amount at the apparatus front-side reinforcing member 46*a* side is decreased compared with that in an initial state of (a) of FIG. 9. Further, in the state of FIG. 4 and (c) of FIG. 7, the peripheral length l' of the intermediary transfer belt 10*e* at the neutral surface is shortened, so that the one rotation period R of the intermediary transfer belt 10*e* in the no-load state is also decreased. In such a way, at the apparatus front-side reinforcing member 46*a* side, compared with the initial state of (a) of FIG. 9, an operation of one rotation becomes fast. Next, the one rotation period of the apparatus rear-side reinforcing member 46*b* is noted. The resultant phenomenon is the reverse of that for the apparatus front-side reinforcing member 46*a*. That is, compared with the initial state of (a) of FIG. 9, the operation of one rotation becomes slow.

The above can also be expressed in the following manner. That is, a width of the overlapping region of the reinforcing member 46*a*, provided with respect to a direction opposite to the lateral shift direction of the intermediary transfer belt 10*e*, with the driving roller 10*f* with respect to the belt widthwise direction M. Then, the rigidity is increased and the elongation amount of the intermediary transfer belt 10*e* is decreased (i.e., the inner peripheral length per unit width of the inner peripheral surface in the overlapping region at the side opposite from the lateral shift side of the intermediary transfer belt 10*e* is shortened), so that the rotation period at the side opposite from the lateral shift side of the intermediary transfer belt 10*e* is shortened.

Further, a width of the overlapping region of the reinforcing member 46*b*, provided with respect to the lateral shift direction of the intermediary transfer belt 10*e*, with the driving roller 10*f* with respect to the belt widthwise direction M. Then, the rigidity is decreased and the elongation amount of the intermediary transfer belt 10*e* is increased (i.e., the inner peripheral length per unit width of the inner peripheral surface in the overlapping region at the lateral shift side of the intermediary transfer belt 10*e* is lengthened), so that the rotation period at the side opposite from the lateral shift side of the intermediary transfer belt 10*e* is lengthened.

Then, the difference in rotation period of the intermediary transfer belt 10*e* with respect to the belt widthwise direction M is generated. That is, the rotation period of the intermediary transfer belt 10*e* at the portion with respect to the lateral shift direction becomes larger than the rotation period of the intermediary transfer belt 10*e* at the portion with respect to the direction opposite from the lateral shift direction. Thus, the apparatus front-side intermediary transfer belt 10*e* portion moves earlier than the apparatus rear-side intermediary transfer belt 10*e* portion. As a result, such a phenomenon that the intermediary transfer belt 10*e* is rotated clockwise in (b) of FIG. 9 occurs. When the intermediary transfer belt 10*e* is rotated clockwise in (b) of FIG. 9, the positional relationship as shown in (c) of FIG. 9 is satisfied. That is, the angle of approach is generated. The angle of approach with respect to this direction has, as described with reference to (c) of FIG. 8, an effect of laterally shifting the intermediary transfer belt 10*e* in the direction opposite from the arrow J direction in which the intermediary transfer belt 10*e* has been laterally shifted.

As the intermediary transfer belt 10*e* is more shifted laterally in the arrow J direction in (b) of FIG. 9, the difference in one rotation period between the apparatus front-side intermediary transfer belt 10*e* portion and the apparatus rear-side intermediary transfer belt 10*e* portion becomes larger. That is, an action for rotating the intermediary transfer belt 10*e* clockwise in (b) of FIG. 9 is strongly exerted. Thus, an amount of the generation of the angle of approach becomes large. The lateral shift is stopped when a balance between a speed at which the intermediary transfer belt 10*e* will laterally shift in the arrow J direction in the initial state of (a) of FIG. 9 and a lateral shift speed generated by the angle of approach produced by the difference in one rotation period of the intermediary transfer belt 10*e* is achieved.

Part (c) of FIG. 9 is not a schematic view showing the state in which the balance is achieved but shows that a force for laterally shifting the intermediary transfer belt 10*e* in the direction opposite from the lateral shift direction is generated by the lateral shift of the intermediary transfer belt 10*e*. As shown in (c) of FIG. 9, the intermediary transfer belt 10*e* is inclined relative to the driving roller 10*f* while being rotated and thus the angle of approach for permitting movement of the intermediary transfer belt 10*e* in the direction opposite from the lateral shift direction is created, so that the lateral shift of the intermediary transfer belt 10*e* is prevented.

Incidentally, the above description is made by using the driving roller 10*f* but the effect in this embodiment is also achieved by another supporting member. The intermediary transfer belt 10*e* is rotationally moved by receiving the force from the driving roller 10*f* and therefore it would be considered that the effect is highest in a region in which the intermediary transfer belt 10*e* contacts the driving roller 10*f*.

Further, the above-described plurality of supporting rollers have the same rotational speed during the rotational movement of the above-described endless belt in the whole region in which the rollers contact the inner peripheral surface of the intermediary transfer belt.

Part (a) of FIG. 10 provides a summary of effects of the reinforcing members 46*a* and 46*b*, and shows how the neutral surface, the tensile strength, the elongation amount of the intermediary transfer belt 10*e* and the inner peripheral length (circumference) change when an overlapping amount of the reinforcing members 46*a* and 46*b* with the rollers is increased. Further, (a) of FIG. 10 shows, as a result, how the rotation period (rotation operation) of the intermediary transfer belt 10*e* changes. Next, an experimental example is shown.

The intermediary transfer belt 10*e* is manufactured of PVDF with 630 (mm) in inner peripheral length, 240 (mm) in width and 80 (μm) in thickness. The driving roller 10*f* has a diameter of 22 (mm) and is subjected to rubber coating of 500 (μm) in thickness at its surface. The tension roller 10*h* has a diameter of 18 (mm) and is manufactured with a hollow aluminum material. A length of a portion of each of the driving roller 10*f* and the tension roller 10*h* where the roller contacts the intermediary transfer belt 10*e* is 225 (mm). Further, by the spring 45, the intermediary transfer belt 10*e* is urged at a force of 2.5 (kgf) at the apparatus front side and 2.5 (kgf) at the apparatus rear side, i.e., at the force of 5 (kgf) in total.

As the reinforcing members 46*a* and 46*b*, a polyester tape of 12 (mm) in width and 25 (μm) in thickness is wound one full circumference. The polyester tape is wound so that the reinforcing members 46*a* and 46*b* are symmetrical with respect to the widthwise direction and so that a center line portion of each of the reinforcing members 46*a* and 46*b* is judged aligned with an edge surface of each of ends of the driving roller. That is, a center distance between the reinforcing members 46*a* and 46*b* is 225 (mm). The driving roller rotates at a speed of two turns per sec. In such a condition, when the main frame 43 is distorted by 1 (mm) between the apparatus front side and the apparatus rear side, the lateral shift is generated at a speed of 30 (μmsec). If the image forming apparatus is mounted at a place where the ground is not flat and an external force is applied, the main frame 43 is distorted by a distance close to 1 (mm) in some cases. For that reason, there is a need that the lateral shift speed of 30 (μm/sec) can be sufficiently prevented by the present invention.

Part (b) of FIG. 10 is a graph showing a relationship between a belt position of the intermediary transfer belt 10*e* provided with the reinforcing members 46*a* and 46*b* with respect to the belt widthwise direction M and the lateral shift speed of the intermediary transfer belt 10*e* in the belt widthwise direction M. The abscissa represents the position of the intermediary transfer belt 10*e*. When the intermediary transfer belt 10*e* is located as the center position as a reference position, the abscissa is zero and the direction in which the intermediary transfer belt 10*e* is moved toward the apparatus rear side is taken as a positive (+) direction. The width of each of the reinforcing members 46*a* and 46*b* is 12 (mm) and therefore when the intermediary transfer belt 10*e* is located at the position of +6, the reinforcing member 46*a* just overlaps entirely with the driving roller 10*f*. At that time, the reinforcing member 46*b* is entirely demounted (detached) from the driving roller 10*f*.

On the other hand, when the intermediary transfer belt 10*e* is located at the position of −6 mm, the reinforcing member 46*a* is entirely demounted from the driving roller 10*f* and the reinforcing member 46*b* entirely overlaps with the driving roller 10*f*. The ordinate represents the lateral shift speed of the intermediary transfer belt 10*e*. The direction in which the intermediary transfer belt 10*e* is moved toward the apparatus rear side is taken as a positive (+) direction. Further, a result of measurement of the lateral shift speed when the position of the intermediary transfer belt 10*e* is changed is the graph of (b) of FIG. 10.

First, the case where the intermediary transfer belt 10*e* is set at the position of −8 mm and then the driving roller 10*f* is rotated will be considered. Then, the lateral shift speed is positive and therefore the intermediary transfer belt 10*e* is moved in the positive direction. That is, the intermediary transfer belt 10*e* is moved toward the origin of the graph. Then, the intermediary transfer belt 10*e* is moved at the same speed until it reaches the position of −6 mm. When the intermediary transfer belt 10*e* is further moved to the position on the right side of the position of −6 mm, the intermediary transfer belt 10*e* is moved toward the origin while gradually lowering its lateral shift speed. Then, in the neighborhood of the origin, the lateral shift speed becomes zero, so that the lateral shift of the intermediary transfer belt 10*e* is stopped. That is, the intermediary transfer belt 10*e* is moved in the direction as indicated by a left-hand arrow in (b) of FIG. 10.

Next, the case where the intermediary transfer belt 10*e* is set at the position of −8 mm and then the driving roller 10*f* is rotated will be considered. Then, the lateral shift speed is negative and therefore the intermediary transfer belt 10*e* is moved in the negative direction. That is, the intermediary transfer belt 10*e* is moved toward the origin of the graph. Then, the intermediary transfer belt 10*e* is moved at the same speed until it reaches the position of (+) 6 mm. When the intermediary transfer belt 10*e* is further moved to the position on the left side of the position of (+) 6 mm, the intermediary transfer belt 10*e* is moved toward the origin while gradually lowering its lateral shift speed. Then, in the neighborhood of the origin, the lateral shift speed becomes zero, so that the lateral shift of the intermediary transfer belt 10*e* is stopped. That is, the intermediary transfer belt 10*e* is moved toward the origin even when the intermediary transfer belt 10*e* is placed at any position.

The lateral shift speed on the ordinate of (b) of FIG. 10 is within ±60 (μ/sec) and therefore it is understood that the lateral shift can be sufficiently prevented even when the main frame 43 is distorted by the distance close to 1 (mm).

Next, from a different viewpoint, the effect of the present invention will be verified. Part (a) of FIG. 11 is a plan view of the intermediary transfer belt 10*e* when the intermediary transfer belt 10*e* is cut at the central portion with respect to the belt widthwise direction M and then is subjected to an experiment. Part (b) of FIG. 11 is a graph showing a relationship between the belt position of the intermediary transfer belt 10*e* with respect to the belt widthwise direction M and a deviation from the reference period in the constitution shown in (a) of FIG. 11. As shown in (a) of FIG. 11, the intermediary transfer belt 10*e* is conveyed in the arrow I direction. Then, how the apparatus rear-side intermediary transfer belt 10*e* provided with the reinforcing member 46*a* change with respect to the reference one rotation period was observed.

In (b) of FIG. 11, the abscissa represents the position of the intermediary transfer belt 10*e*. When the intermediary transfer belt 10*e* is located at the center position as a reference position, the abscissa is zero, and the direction in which the intermediary transfer belt 10*e* is moved toward the apparatus rear side is taken as a positive (+) direction. The ordinate represents an amount (msec) of deviation of the period, from the reference, of the apparatus front-side intermediary transfer belt 10*e* provided with the reinforcing member 46*a*. When the one rotation period of the apparatus front-side intermediary transfer belt 10*e* provided with the reinforcing member 46*a* is short, the deviation amount shows a negative value on the graph. A result of measurement of the deviation amount of the period from the reference when the position of the intermediary transfer belt 10*e* is changed is shown in (b) of FIG. 11.

From (b) of FIG. 11, it is understood that the rotation period is deviated by the change in position of the intermediary transfer belt 10*e*. Also (b) of FIG. 11, similarly as in the mathematical expression 16, the rotation period becomes smaller with a larger overlapping amount of the reinforcing member 46*a*. That is, by changing the tensile strength by using the reinforcing member 46*a*, the rotation period is changed and thus the angle of approach is generated. As described above, it is understood that the lateral shift of the intermediary transfer belt 10*e* can be prevented by the present invention.

Embodiment 2

Next, Embodiment 2 will be specifically described. A constitution of an intermediary transfer belt unit (hereinafter referred to as an "intermediary transfer unit 210") which is a belt unit in this embodiment will be described. The constitution of the intermediary transfer unit 210 in this embodiment is the same as that of the intermediary transfer unit 10 in Embodiment 1. Therefore, the same constitution as that in Embodiment 1 will be omitted from the description. Further, other constitutions similar to those in Embodiment 1 are the same as the contents described in Embodiment 1.

First, a mechanism for preventing the belt lateral shift of the intermediary transfer belt 10*a* according to Embodiment 2 of the present invention will be specifically described with reference FIGS. 12 to 14. Parts (a) and (b) of FIG. 12 are schematic sectional views of a general intermediary transfer unit 510 as seen from an upper surface side. Parts (a) and (b) of FIG. 14 are schematic sectional view of the intermediary transfer unit 210 according to Embodiment 2 of the present invention as seen from an upper surface side.

In FIGS. 12 to 14, the intermediary transfer units 510 and 210 are designed as a left-right (bilateral) symmetrical system. However, the left-right symmetrical system refers to a design reference position, and variations of parts and assembling are not taken into consideration. Further, the intermediary transfer belt 10*e* is moved in an arrow I direction. When the driving roller 10*f* is driven and rotated, the intermediary transfer belt 10*e* is rotationally moved. When the intermediary transfer belt 10*e* is rotationally moved, the intermediary transfer belt 10*e* is started to be shifted along the angle of approach formed due to the variations of the parts and the assembling. In this embodiment, the case where the intermediary transfer belt 10*e* is shifted in an arrow D direction in (a) of FIG. 12 is shown as an example. In the general intermediary transfer unit 510, when the intermediary transfer belt 10*e* is shifted from the initial state in the arrow D direction, the tension roller 10*h* is slightly moved as shown in (b) of FIG. 12. This occurs based on a relationship of a balance of moments.

In order to imaginably illustrate the balance of the moments, description will be made with reference to FIG. 13. FIG. 13 is a schematic plan view of the tension roller 10*h* and the driving roller 10*f* as seen from an upper surface side. The intermediary transfer belt 10*e* is illustrated in an extremely narrow state.

As shown in FIG. 13, it is assumed that the intermediary transfer belt 10*e* is shifted in the arrow D direction. Further, a force applied from the spring 45 located with respect to a direction opposite from the arrow D direction is f-a, a force applied from the spring 45 located with respect to the arrow D direction is f-b, and a total force applied from the intermediary transfer belt 10*e* is f-10*e*. Here, these springs 45 are an urging member provided with predetermined elasticity.

At this time, first, the moment about a point C-a is considered. When the intermediary transfer belt 10*e* is shifted in the right direction (the apparatus rear side), a distance between the point C-a and the total force f-10*e* applied from the intermediary transfer belt 10*e* becomes long. The moment balanced with f-10*e* in the force f-b applied from the spring 45. Assuming that a magnitude of f-10*e* is not changed from the relationship of the balance even when the intermediary transfer belt 10*e* is laterally shifted, if the intermediary transfer belt 10*e* is shifted in the arrow D direction, the force f-b applied from the spring 45 has to be increased. For that reason, the spring 45 located with respect to the arrow D direction (at the apparatus rear side) is somewhat contracted.

On the other hand, the moment about a point C-b is considered. When the intermediary transfer belt 10*e* is shifted in the right direction (the apparatus rear side), a distance between the point C-b and the total force f-10*e* applied from the intermediary transfer belt 10*e* becomes short. The moment balanced with f-10*e* in the force f-a applied from the spring 45. Assuming that a magnitude of f-10*e* is not changed from the relationship of the balance even when the intermediary transfer belt 10*e* is laterally shifted, if the intermediary transfer belt 10*e* is shifted in the arrow D direction, the force f-a applied from the spring 45 has to be decreased. For that reason, the spring 45 located with respect to the direction opposite from the arrow D direction (at the apparatus front side) is somewhat expanded.

FIG. 13 shows an extreme example but also in the states shown in (a) and (b) of FIG. 12, the force applied from the intermediary transfer belt 10*e* is slightly changed. Further, when the intermediary transfer belt 10*e* is shifted from the initial state of (a) of FIG. 12 in the arrow D direction, the tension roller 10*h* is moved as shown in (b) of FIG. 12.

However, according to the constitution in this embodiment, the tension roller 10*h* can be moved in a direction opposite from the movement direction of the tension roller 10*h* shown in (b) of FIG. 12. That is, when the intermediary transfer belt 10*e* is shifted from the state of (a) of FIG. 14 in the arrow D direction, the tension roller 10*h* is moved as shown in (b) of FIG. 14. In a direction opposite to that in (b) of FIG. 12, the tension roller 10*h* is inclined.

The mechanism reason why the movement of the tension roller 10*h* is opposite from that in the case of (b) of FIG. 12 will be described. In short, similarly as described in Embodiment 1, the movement of the tension roller 10*h* as shown in (b) of FIG. 14 occurs due to the change in tensile strength.

When the intermediary transfer belt 10*e* is shifted from the state of (a) of FIG. 14 in the arrow D direction, the overlapping amount of the reinforcing member 46*a* with the driving roller 10*f* is increased. When the overlapping amount of the reinforcing member 46*a* with the driving roller 10*f* is increased, the cross-sectional area $A_{c-a}$ of the reinforcing member 46*a* contributing to the tensile strength is increased. Then, at the side where the reinforcing member 46*a* is located, the elongation amount will be decreased.

On the other hand, based on the relationship of the balance of moments, the apparatus front-side spring 45 will be expanded. If a component for reducing the elongation amount of the reinforcing member 46*a* is, based on the relationship of the balance of moments, larger than a component for expanding the spring 45, the tension roller 10*h* is moved as shown in (b) of FIG. 14.

This is true for the apparatus rear side.

When the intermediary transfer belt 10*e* is shifted from the state of (a) of FIG. 14 in the arrow D direction, the overlapping amount of the reinforcing member 46*b* with the driving roller 10*f* is decreased. When the overlapping amount of the reinforcing member 46*b* with the driving roller 10*f* is decreased, the cross-sectional area $A_{c-b}$ of the reinforcing member 46*b* contributing to the tensile strength is decreased. Then, at the side where the reinforcing member 46*b* is located, the elongation amount will be increased.

On the other hand, based on the relationship of the balance of moments, the apparatus rear-side spring 45 will be contracted. If a component for increasing the elongation amount of the reinforcing member 46*b* is, based on the relationship of the balance of moments, larger than a component for contracting the spring 45, the tension roller 10*h* is moved as shown in (b) of FIG. 14. Thus, when the reinforcing members 46*a* and 46*b* are used, as shown in (b) of FIG. 14, the tension roller 10*h* can be moved in the direction opposite from that of the movement of the tension roller 10*h* shown in (b) of FIG. 12.

In order to make a degree of the reinforcing members 46*a* and 46*b* contributing to the movement of the tension roller 10*h* larger than a degree of the springs which will more the tension roller 10*h* based on the balance of moments, the following methods can be employed. First, a distance between the apparatus front-side spring 45 and the apparatus rear-side spring 45 increased. Secondly, spring constant of the spring 45 is decreased. Thirdly, as shown in FIG. 4, the inner peripheral length at the places where the reinforcing members 46*a* and 46*b* are provided is decreased.

As other methods, when a total tension (pressure), the tensile strength of the reinforcing members 46*a* and 46*b* and the tensile strength of the intermediary transfer belt 10*e* are changed, the degree of magnitude can be changed.

Particularly, as shown in FIG. 4, when the inner peripheral length at the places where the reinforcing members 46*a* and 46*b* are provided, the movement of the tension roller 10*h* as shown in (b) of FIG. 14 can be realized relatively easily. This is easy to understand when the state of (b) of FIG. 8 is taken into consideration.

With a larger amount of overlapping of the reinforcing member 46*a* with the driving roller 10*f*, the tensile strength at the side where the reinforcing member 46*a* is provided is larger. This is because the cross-sectional area of the reinforcing member 46*a* is increased. If the Young's modulus of the reinforcing member 46*a* is sufficiently high and there is a sufficient inner peripheral length difference as shown in FIG. 4, in the case where the overlapping amount of the reinforcing member 46*a* with the driving roller 10*f* becomes large, the elongation deformation of the intermediary transfer belt 10*e* is suppressed almost by only the reinforcing member 46*a*. In that state, the inner peripheral length of the intermediary transfer belt 10*e* at the reinforcing member 46*a* side is extremely short. As a result, corresponding to the shortened inner peripheral length, as shown in (b) of FIG. 14, the tension roller 10*h* causes misalignment.

Briefly speaking in a time-series manner, the following phenomenon occurs. The reinforcing member 46*a* with respect to the direction opposite from the direction in which the intermediary transfer belt 10*e* is shifted is increased in overlapping amount thereof which the rollers (10*f*, 10*g*, 10*h*), so that the inner peripheral length per unit width of the inner peripheral surface of the intermediary transfer belt 10*e* becomes short. A force of the tension roller 10*h* against the tension is increased with respect to the direction opposite from the direction in which the intermediary transfer belt 10*e* is shifted is increased. The position of the tension roller 10*h* with respect to the direction opposite from the direction in which the intermediary transfer belt 10*e* is shifted moves in a direction in which it approaches the driving roller 10*f*.

On the other hand, the amount of overlapping of the reinforcing member 46*a* with the driving roller 10*f* is decreased at the side where the reinforcing member 46*b* is provided, so that the tensile strength weakens. This is because the cross-sectional area of the reinforcing member 46*b* is decreased. As a result, the elongation deformation of the intermediary transfer belt 10*e* cannot be suppressed by only the reinforcing member 46*b*. Further, the intermediary transfer belt 10*e* is elongated and the inner peripheral length at the side where the reinforcing member 46*b* is provided is increased. As a result, corresponding to the elongated inner peripheral length, the tension roller 10*h* is moved. That is, as shown in (b) of FIG. 14, the tension roller 10*h* causes misalignment.

Briefly speaking in a time-series manner, the following phenomenon occurs. The reinforcing member 46*b* with respect to the direction in which the intermediary transfer belt 10*e* is shifted is decreased in overlapping amount thereof which the rollers (10*f*, 10*g*, 10*h*), so that the inner peripheral length per unit width of the inner peripheral surface of the intermediary transfer belt 10*e* becomes long. A force of the tension roller 10*h* against the tension is increased with respect to the direction in which the intermediary transfer belt 10*e* is shifted is decreased. The position of the tension roller 10*h* with respect to the direction in which the intermediary transfer belt 10*e* is shifted moves in a direction in which it goes away from the driving roller 10*f*.

Further, description will be made with reference to the mathematical expression 16. In Embodiment 1, with reference to FIG. 4 and (c) of FIG. 7, the change in peripheral length at the neutral surface was described. When the peripheral length l' is finely observed with respect to the widthwise direction, the value of l' is finely observed with respect to the widthwise direction, the value of l' is continuously changed between the portion where the reinforcing member 46 is provided and the portion where the reinforcing member 46 is provided and the portion where the reinforcing member 46 is not provided. The value of l' is small at the portion where the reinforcing member 46 is provided and is gradually increased toward the portion where the reinforcing member 46 is not provided. For that reason, when the intermediary transfer belt 10*e* is moved, the tension roller 10*h* causes the misalignment as shown in (b) of FIG. 14.

Thus, when the inner peripheral length at the places where the reinforcing members 46*a* and 46*b* are provided is made small, it is possible to relatively easily increase the degree of the reinforcing members 46*a* and 46*b* contributing to the movement of the tension roller 10*h*.

Next, a mechanism of the prevention of the lateral shift when the tension roller 10*h* is moved as shown in (b) of FIG. 14 will be described. In actually, the mechanism described in Embodiment 1 also holds in the case where the tension roller 10*h* is fixed so as not to slide and thus is stationary. On the other hand, the contents described in Embodiment 2 are the mechanism of the prevention of the lateral shift generated only in the case where the shifts of the tension roller 10*h* are urged by the springs and the end portions of the tension roller 10*h* are moved in the belt movement direction.

Before describing the mechanism in Embodiment 2, some notes will be added to Embodiment 1. First, a geometrical peripheral length of the intermediary transfer belt 10*e* will be defined. Parts (a) and (b) of FIG. 14 are illustrations of the geometrical peripheral length of the intermediary transfer belt 10*e*. As shown in (a) and (b) of FIG. 15, in the state the tensions $T_1$ and $T_2$ are applied at each of the upstream side and the downstream side, the peripheral length of the intermediary transfer belt 10*e* at the neutral surface will be referred to as the geometrical peripheral length.

The mechanism described in Embodiment 1 holds in both of the case where the tension roller 10*h* is fixed and stationary and the case where the tension roller 10*h* is moved. This is because the one rotation period can be changed based on the mathematical expression 16 even when the geometrical peripheral length of the intermediary transfer belt 10*e* is not changed. The mathematical expression 16 is an expression only for deriving a period time from a tension-side path (course) until the intermediary transfer belt 10*e* rotates one full circumference, on the basis of a tension-side elongation amount and a radius to the neutral surface. Therefore the mathematical expression 16 does not define the geometrical peripheral length of the intermediary transfer belt 10*e*.

That is, if a tension-side tension is high and a loose-side tension is low, even when the geometrical peripheral length is not changed, the change in one rotation period can be caused. If the geometrical peripheral length of corresponding to one full circumference of the intermediary transfer belt 10*e* is not changed, there is no need to change the position of the tension roller 10*h*. Therefore, irrespective of the inclination of the tension roller 10*h*, the mechanism described in Embodiment 1 holds.

On the other hand, the contents described in Embodiment 2 are the mechanisms of the prevention of the lateral shift generated in the case where the tension roller 10*h* is moved. One of the mechanisms of the prevention of the lateral shift in Embodiment 2 is described by a difference in one rotation period.

In (b) of FIG. 14, compared with the apparatus rear side, the geometrical peripheral length of the intermediary transfer belt 10*e* is short at the apparatus front side where a spacing between the tension roller 10*h* and the driving roller 10*f* is small (short). Further, the geometrical peripheral length at the apparatus front side is shortened and therefore a period required for one rotation is short. That is, compared with the apparatus rear side, the intermediary transfer belt 10*e* moves early at the apparatus front side. As a result, the intermediary transfer belt 10*e* is inclined relative to the driving roller 10*f* and is wound about the driving roller 10*f*. At that time, the angle of approach is generated with respect to a direction in which the intermediary transfer belt 10*e* is moved in a direction opposite from the arrow D direction in which the intermediary transfer belt 10*e* is shifted. Thus, the lateral shift of the intermediary transfer belt 10*e* is prevented.

The other mechanism is described by the angle of approach generated by the inclination of the driving roller 10*f* and the tension roller 10*h*. That is the angle of approach created by a factor other than the period difference.

Assuming that the intermediary transfer belt 10*e* is shifted in the arrow D direction in (b) of FIG. 14, in Embodiment 2, the two rollers are inclined as shown in (b) of FIG. 14. Thus, by a geometrical action corresponding to the inclination, the angle of approach is generated. The intermediary transfer belt 10*e* will be follow the surfaces of the two rollers and therefore the angle of approach as shown in (b) of FIG. 14 is created geometrically. The angle of approach acts in a lateral shift prevention direction. As a result, the lateral shift is prevented by the angle of approach geometrically created by the inclination of the tension roller 10*h* relative to the driving roller 10*f*.

Then, based on the above-described mechanisms, a state of the prevention of the lateral shift of the intermediary transfer belt 10*e* will be described in a time-series manner. In (a) of FIG. 14, when the intermediary transfer belt 10*e* is rotationally moved, the intermediary transfer belt 10*e* is moved (shifted) in the arrow D direction. As a result, as shown in (b) of FIG. 14, the overlapping region 46*a*-1 in which the apparatus front-side reinforcing member 46*a* overlaps with the driving roller 10*a* is increased, and the overlapping region 46*b*-1 in which the apparatus rear-side reinforcing member 46*b* overlaps with the driving roller 10*f*.

At this time, the cross-sectional area A of the reinforcing member 46*a* contributing to the tensile strength is increased, so that the tensile strength is increased. On the other hand, the cross-sectional area $A_a$ of the reinforcing member 46*b* contributing to the tensile strength is decreased, so that the tensile strength is decreased. By this effect, the tension roller 10*h* is inclined as shown in (b) of FIG. 14.

At this time, the peripheral length l' at the reinforcing member 46*a*-side neutral surface becomes small, and the peripheral length l' at the reinforcing member 46*b*-side neutral surface becomes large. In other words, the geometrical peripheral length at the reinforcing member 46*a* side is shortened, and the geometrical peripheral length at the reinforcing member 46*b* side is lengthened. Based on a relationship between these peripheral lengths, the rotation operation at the reinforcing member 46*a* side becomes fast, and the rotation operation at the reinforcing member 46*b* side becomes slow.

These are expressed in another way for each of the reinforcing members 46*a* and 46*b* as follows. When the reinforcing member 46*a* with respect to the direction opposite from the lateral shift direction of the intermediary transfer belt 10*e* is increased in overlapping width with the roller, the inner peripheral length per unit width of the inner peripheral surface of the intermediary transfer belt 10*e* is shortened to shorten the rotation period, so that the rotation operation of the reinforcing member 46*a* becomes fast. Further, when the reinforcing member 46*b* with respect to the lateral shift direction of the intermediary transfer belt 10*e* is decreased in overlapping width with the roller, the inner peripheral length per unit width of the inner peripheral surface of the intermediary transfer belt 10*e* is lengthened to lengthen the rotation period, so that the rotation operation of the reinforcing member 46*b* becomes slow.

Further, as described in Embodiment 1, by the increase of the tensile strength of the reinforcing member 46*a*, the rotation period of the intermediary transfer belt 10*e* at the reinforcing member 46*a* side is shortened, so that the rotational speed becomes fast. At the opposite side, the tensile strength of the reinforcing member 46*b* is decreased to lengthen the rotation period of the intermediary transfer belt 10*e* at the reinforcing member 46*b* side, so that the rotational speed becomes slow. That is, based on the relationship between the tensile strengths, the differences in rotation period and rotational speed are generated between the reinforcing member 46*a* side and the reinforcing member 46*b* side.

Thus, the effect of the peripheral length and the effect of the tensile strength are combined, so that the intermediary transfer belt 10*e* moves early at the reinforcing member 46*a* side relative to the reinforcing member 46*b* side. As a result, the intermediary transfer belt 10*e* is rotated counterclockwise as shown in (b) of FIG. 14, so that the angle of approach is generated with respect to the lateral shift prevention direction.

At this time, the tension roller 10*h* is inclined relative to the driving roller 10*f* and the intermediary transfer belt 10*e* will follow the surfaces of the two rollers, so that the geometrical angle of approach is generated. This angle of approach also acts with respect to the lateral shift prevention direction. By all these effects, the lateral shift preventing action functions.

The amount of the inclination of the tension roller 10*h* becomes larger as the intermediary transfer belt 10*e* is more shifted in the arrow D direction. For that reason, as the intermediary transfer belt 10*e* is more shifted in the arrow D direction, a larger angle of approach is generated with respect to the lateral shift prevention direction. Then, the intermediary transfer belt 10*e* is gradually moved in the arrow D direction, and the lateral shift is stopped when a balance between a speed at which the intermediary transfer belt 10*e* will laterally shift in the arrow D direction in the initial state of (a) of FIG. 14 and a lateral shift speed generated by the effect of the present invention is achieved.

Part (b) of FIG. 14 is not a schematic view showing the state in which the balance is achieved but is an illustration for explaining generation of a force, for laterally shifting the intermediary transfer belt 10*e* in the direction opposite from the lateral shift direction, by the lateral shift of the intermediary transfer belt 10*e*.

As experiment example is shown. In the same belt unit constitution as that in Embodiment 1, the spring constant of 2.1 (N/mm) is used for the springs 45. In order to provide the inner peripheral length difference as shown in FIG. 4, a polyester-made reinforcing member of 12 (mm) in width and 25 (μm) in thickness is pulled with a force of about 30 (N) and is applied to the intermediary transfer belt.

Part (c) of FIG. 15 is a graph for verifying the effect of the present invention. Under the above-described condition, the inclination of the tension roller 10*h* is observed. The abscissa represents the position of the intermediary transfer belt 10*e*. The abscissa is zero when the intermediary transfer belt 10*e* is located as the center position as the reference position, and the direction in which the intermediary transfer belt 10*e* moves toward the apparatus rear side is taken as the positive direction. The ordinate represents an inclination amount (μm) of the tension roller 10*h*.

Part (c) of FIG. 15 is a plot of a difference in absolute position of the tension roller 10*h* between the apparatus front side where the reinforcing member 46*a* is provided and the apparatus rear side where the reinforcing member 46*b* is provided. In (c) of FIG. 15, when the tension roller 10*h* at the apparatus front side where the reinforcing member 46*a* is provided is moved away from the driving roller 10*f*, the difference shows the positive value.

As is understood from (c) of FIG. 15, the tension roller 10*h* is inclined similarly as in (b) of FIG. 14. When the intermediary transfer belt 10*e* is shifted rightward in (b) of FIG. 14, the apparatus front-side tension roller 10*h* is inclined in a direction in which it approaches the driving roller 10*f*. On the other hand, when the intermediary transfer belt 10*e* is shifted leftward in (b) of FIG. 14, the apparatus front-side tension roller 10*h* is inclined in a direction in which it is moved away from the driving roller 10*f*. As a result, it is understood that the motion of the tension roller 10*h* can be changed by the constitution in this embodiment.

Part (a) of FIG. 16 is a graph for verifying the influence of the inner peripheral length difference in this embodiment. The abscissa represents the position of the intermediary transfer belt 10*e*. The abscissa is zero when the intermediary transfer belt 10*e* is located at the center position as the reference position, and the direction in which the intermediary transfer belt 10*e* moves toward the apparatus rear side is taken as the positive direction. The ordinate represents the lateral shift speed of the intermediary transfer belt 10*e*. The direction in which the intermediary transfer belt 10*e* moves toward the apparatus rear side is taken as the positive direction.

Further, results of the lateral shift speeds in the case where the inner peripheral length difference is made large and in the case where the inner peripheral length difference is made small were compared. Under a condition of the large inner peripheral length difference, the reinforcing member is pulled and applied with a force of about 30 (N), and under a condition of the small inner peripheral length difference, the reinforcing member is pulled and applied with a force of about 10 (N). The results of measurement of the lateral shift speed at changed positions of the intermediary transfer belt are shown in (a) of FIG. 16.

In (a) of FIG. 16, a degree of the change in lateral shift speed is larger with a larger inner peripheral length difference. That is, it is understood that even when the change in overlapping amount of the intermediary transfer belt 10*e* is small, a larger lateral shift-preventing effect is achieved. From the above, in this embodiment, it is understood that the lateral shift-preventing effect is high when the inner peripheral length different is made large.

Part (b) of FIG. 16 is a graph for verifying the effect of the inclination of the tension roller 10*h* in the present invention. In the mechanism in Embodiment 1, the achievement of the effect even when the tension roller 10*h* is fixed was described. On the other hand, in the mechanism in Embodiment 2, the effect is not achieved when the tension roller 10*h* is fixed. For that reason, the case where the tension roller 10*h* is fixed and the case where the tension roller 10*h* is not fixed are compared, so that the effect by the inclination of the tension roller 10*h* in the present invention is verified.

In (b) of FIG. 16, the abscissa represents the position of the intermediary transfer belt 10*e*. The abscissa is zero when the intermediary transfer belt 10*e* is located at the center position as the reference position, and the direction in which the intermediary transfer belt 10*e* is moved toward the apparatus rear side is taken as the positive direction. The ordinate represents the lateral shift speed of the intermediary transfer belt 10*e*. The direction in which the intermediary transfer belt 10*e* is moved toward the apparatus rear side is taken as the positive direction. Further, the position of the intermediary transfer belt 10*e* is changed between the case where the tension roller 10*h* is fixed and the case where the tension roller 10*h* is not fixed.

In (b) of FIG. 16, in the case where the tension roller 10*h* is not fixed, a degree of the change in lateral shift speed is larger than that in the case where the tension roller 10*h* is fixed. That is, it is understood that even when the degree of the change in overlapping amount of the intermediary transfer belt 10*e* is small, a larger lateral shift-preventing effect is achieved.

From the above, in the present invention, it is understood that the tension roller 10*h* is moved based on the mechanism in Embodiment 2 and thus the lateral shift is prevented also by the effect of the movement.

Embodiment 3

Next, Embodiment 3 of the present invention will be specifically described. A constitution of an intermediary transfer belt unit (hereinafter referred to as an "intermediary transfer unit 310") which is a belt unit in Embodiment 3 will be described with reference to (a) of FIG. 17. Part (a) of FIG. 17 is a schematic partial perspective view of the intermediary transfer unit 310 according to Embodiment 3 of the present invention. The constitution of the intermediary transfer unit 310 in Embodiment 3 is the same as those of the intermediary transfer units 10 and 210 in Embodiments 1 and 2. Therefore, the same constitution as those in Embodiments 1 and 2 will be omitted from the description. Further, other constitutions similar to those in Embodiments 1 and 2 are the same as the contents described in Embodiments 1 and 2.

Differences are that the reinforcing member 46*a* is provided only at the apparatus front side and that the intermediary transfer belt 10*e* (not shown) is designed to provide alignment such that it is always shifted toward the apparatus rear side. That is, the intermediary transfer belt 310 includes a forcedly moving means for forcedly moving the intermediary transfer belt 10*e* is one direction by imparting a shifting force, to the intermediary transfer belt 10*e*, toward the one direction of the belt widthwise direction M perpendicular to the arrow I direction which is the belt rotational direction. Further, the intermediary transfer unit 310 is provided with the reinforcing member 46*a* for reinforcing the intermediary transfer belt 10*e* at an end side (end portion) of the outer peripheral surface of the intermediary transfer belt 10*e* with respect to a direction opposite from the one direction of the belt widthwise direction M. The reinforcing member 46*a* is provided so as to extend one full circumference of the outer peripheral surface of the intermediary transfer belt 10*e* with a predetermined width.

First, a mechanism of the prevention of the belt lateral shift of the intermediary transfer belt 10*e* will be specifically described with reference to (b) of FIG. 17, (a) of FIG. 18 and (b) of FIG. 18. Part (b) of FIG. 17 is a partly enlarged perspective view of (a) of FIG. 17. Part (a) of FIG. 18 is a sectional view of the tension roller 10*h* as seen from the belt rotational direction. Part (b) of FIG. 18 is a sectional view of the tension roller 10*h* as seen from the belt rotational direction.

Part (a) of FIG. 18 shows a design reference position. From this state, when the intermediary transfer belt 10*e* is rotated, the intermediary transfer belt 10*e* is started to be shifted toward the apparatus rear side in an arrow L direction. This is because such a design (forcedly moving means) that the intermediary transfer belt 10*e* is shifted toward the apparatus rear side is made in consideration of various variations such as a tension difference between the front and rear springs 45, misalignment among the rollers (10*f*, 10*g*, 10*h*) and variation in dimension of parts constituting the mechanism.

As a constitution of the forcedly moving means, e.g., those described below are cited. For example, there is a constitution in which an urging force of the spring 45 for urging the apparatus rear-side supporting side plate 44 in (a) of FIG. 17 is set to be weak and an urging force of the spring 45 for urging the apparatus front-side supporting side plate 44 in (a) of FIG. 17 is set to be strong, so that the intermediary transfer belt 10*e* is shifted to the rear side in (a) of FIG. 17. Further, e.g., there is a constitution in which a pitch between end portions of the plurality of rollers (10*f*, 10*g*, 10*h*) is set to be narrow at the rear side in (a) of FIG. 17 and a pitch between end portions of the plurality of rollers (10*f*, 10*g*, 10*h*) is set to be wide.

In (b) of FIG. 18, when the intermediary transfer belt 10*e* is moved in the arrow L direction, a positional relation between the intermediary transfer belt 10*e* and the tension roller 10*h* is changed. As shown in (b) of FIG. 18, the overlapping region 46*a*-1 in which the apparatus front-side reinforcing member 46*a* overlaps with the tension roller 10*h* is increased.

When such a change is caused, as described in Embodiment 1 or Embodiment 2, the angle of approach for permitting lateral shift of the intermediary transfer belt 10*e* in the direction opposite from the arrow L direction in which the intermediary transfer belt 10*e* is shifted. Further, the angle of approach in the initial stage in which the intermediary transfer belt 10*e* is shifted in the arrow L direction is canceled by the angle of approach generated by movement of the intermediary transfer belt 10*e*, so that the belt lateral shift of the intermediary transfer belt 10*e* is prevented when the balance is achieved.

When the same expression as those in Embodiments 1 and 2 is given, the following can be said in the time-series manner. When the prevent 10*f* is rotated and the intermediary transfer belt 10*e* is started to be shifted in the one direction of the belt widthwise direction M, the reinforcing member 46*a* disposed in the direction opposite from the one direction of the belt widthwise direction M is increased in overlapping width with the roller. The rigidity is increased and the elongation amount of the intermediary transfer belt 10*e* is decreased (the inner peripheral length per unit width of the inner peripheral surface of the intermediary transfer belt 10*e* is shortened), so that the rotation period is shortened.

Further, the rotation period of the intermediary transfer belt 10*e* at a portion with respect to the one direction becomes larger than the rotation period of the intermediary transfer belt 10*e* at a portion with respect to a direction opposite from the one direction, so that the intermediary transfer belt 10*e* is inclined relative to the driving roller 10*f* while rotating. As a result, the angle of approach for permitting the shift of the intermediary transfer belt 10*e* in the direction opposite from the one direction is created and thus the lateral shift of the intermediary transfer belt 10*e* is prevented.

Further, as in Embodiment 2, when the axis of the tension roller 10*h* is constituted so that it can be inclined, the following is caused. That is, when the driving roller 10*f* is rotated and the intermediary transfer belt 10*e* is started to be shifted in the one direction of the belt widthwise direction M, the reinforcing member 46*a* disposed with respect to the direction opposite from the one direction of the belt widthwise direction M. The inner peripheral length per unit width of the inner peripheral surface of the intermediary transfer belt 10*e* is shortened, so that a force of the tension roller 10*h* against the tension is increased with respect to the direction opposite from the lateral shift direction of the intermediary transfer belt 10*e*. The position of the tension roller 10*h* with respect to the direction opposite from the lateral shift direction of the intermediary transfer belt 10*e* is moved in the direction in which the tension roller 10*h* approaches the driving roller 10*f*.

Then, the axis of the tension roller 10*h* is inclined relative to the axis of the driving roller 10*f* to create the angle of approach for permitting the lateral shift of the intermediary transfer belt 10*e* in the direction opposite from the one direction, so that the lateral shift of the intermediary transfer belt 10*e* is prevented.

According to the constitution in Embodiments 1 to 3, the lateral shift of the intermediary transfer belt 10*e* can be prevented without providing the rib at the inner peripheral surface of the intermediary transfer belt 10*e*. Specifically, with respect to the lateral shift of the intermediary transfer belt 10*e* in the image forming apparatus, a rigid difference or peripheral length difference between the portion to which the reinforcing members 46*a* and 46*b* are applied and the portion to which the reinforcing members 46*a* and 46*b* are applied is appropriately set. As a result, the shift of the intermediary transfer belt 10*e* in the widthwise direction can be prevented.

For that reason, there is no need to provide the abutment member, such as the projection-like guide member or rib, at the inner peripheral surface of the intermediary transfer belt 10*e*. That is, the inner peripheral surface is smooth. Further, the contact surfaces of the driving roller 10*f*, the tension roller 10*h* and the opposite roller 10*g* which contact the inner peripheral surface of the intermediary transfer belt 10*e* are formed so that the friction resistance is the same over the belt widthwise direction.

The constitution in which the member abuts the rollers as in the case of the rib is not employed and therefore the lifetime elongation of the intermediary transfer belt 10*e* can be realized. In the case of the rib, when straightness is not sufficient, the intermediary transfer belt 10*e* meanders largely but compared with that case, an amount of meandering can be reduced in the present invention.

Further, not only a cost of the rib alone can be reduced but also a step of applying the projection-like guide member or rib can be omitted to enhance a manufacturing efficiency, so that a manufacturing cost can be reduced. There is no need to provide a particular mechanism in addition to the reinforcing members 46*a* and 46*b* and therefore a cost and a space which are required for the particular mechanism can be saved.

Incidentally, in Embodiments 1 to 3, as the constitution of the above-described belt unit, the intermediary transfer units 10, 210 and 310 are exemplified but the present invention is not limited to this constitution. That is, the constitution of the belt unit can also be applied to a secondary transfer belt, a transfer material carrying member, and the like and is further applicable to other mechanisms for conveying the transfer material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 064336/2011 filed Mar. 23, 2011, which is hereby incorporated by reference.

What is claimed is:

1. A belt unit comprising:

a rotatable endless belt for receiving a toner image thereon or for conveying a transfer material;

a first reinforcing member, provided on an outer peripheral surface of said endless belt at one end portion with respect to a belt widthwise direction perpendicular to a movement direction of said endless belt, for reinforcing said endless belt;

a second reinforcing member, provided on the outer peripheral surface of said endless belt at the other end portion with respect to the belt widthwise direction perpendicular to the movement direction of said endless belt, for reinforcing said endless belt; and a driving roller for rotationally driving said endless belt while supporting the inner peripheral surface of said endless belt, wherein in the belt widthwise direction, a first length from an inner edge surface of said first reinforcing member to an inner edge surface of said second reinforcing member is smaller than a width of a region in which said driving roller contacts said endless belt, and a second length from an outer edge surface of said first reinforcing member to an outer edge surface of said second reinforcing member is larger than the width of the region in which said driving roller contacts said endless belt, and wherein said endless belt is free of a projected portion projecting from the inner peripheral surface over the belt widthwise direction.

2. A belt unit according to claim 1, wherein when said endless belt laterally shifts toward said second reinforcing member in the belt widthwise direction, a width of a first region of the inner peripheral surface of said endless belt corresponding to a region in which said first reinforcing member is provided on the outer peripheral surface of said endless belt is increased more than a width of a second region of the inner peripheral surface of said endless belt corresponding to a region in which said second reinforcing member is provided on the outer peripheral surface of said endless belt.

3. A belt unit according to claim 2, wherein when said endless belt laterally shifts toward said second reinforcing member in the belt widthwise direction, an inner peripheral length of the first region of the inner peripheral surface of said endless belt corresponding to a region in which said first reinforcing member is provided on the outer peripheral surface of said endless belt is shortened, and an inner peripheral length of the second region of the inner peripheral surface of said endless belt corresponding to a region in which said second reinforcing member is provided on the outer peripheral surface of said endless belt is lengthened, so that said endless belt is inclined relative to said supporting members, while being rotated, by a difference in rotation period generated with respect to the belt widthwise direction thereby to create an angle of approach for permitting movement of said endless belt toward said first reinforcing member.

4. A belt unit according to claim 3, further comprising a plurality of supporting members for supporting the inner peripheral surface of said endless belt, wherein said driving roller is fixed so that shafts of the supporting rollers are kept in a parallel state.

5. A belt unit according to claim 4, wherein said driving roller has the same rotational speed during rotational movement of said endless belt in a whole region in which the supporting rollers contact the inner peripheral surface of said endless belt.

6. A belt unit according to claim 4, wherein said driving roller has the same frictional resistance in a whole region in which the supporting rollers contact the inner peripheral surface of said endless belt.

7. A belt unit according to claim 4, wherein one of said supporting rollers is a tension roller for urging said endless belt from the inner peripheral surface toward the outer peripheral surface by an urging member, and wherein when said endless belt laterally shifts toward said second reinforcing member in the belt widthwise direction, a position of the tension roller at a first reinforcing member side moves in a direction toward the driving roller by shortening an inner peripheral length in the first region of the inner peripheral surface of said endless belt corresponding to the region in which said first reinforcing member is provided on the outer peripheral surface of said endless belt, and a position of the tension roller at a second reinforcing member side moves in a direction away from the driving roller by lengthening an inner peripheral length in the second region of the inner peripheral surface of said endless belt corresponding to the region in which said second reinforcing member is provided on the outer peripheral surface of said endless belt, so that an axis of the tension roller is inclined relative to an axis of the driving roller to create an angle of approach for permitting movement of said endless belt toward said first reinforcing member to prevent lateral shift of said endless belt.

8. A belt unit according to claim 1, wherein each of said first reinforcing member and said second reinforcing member is an adhesive tape.

9. A belt unit according to claim 1, wherein even when said endless belt is shifted toward either one of the end portions in the belt widthwise direction, there is a first region in which said first reinforcing member opposes said driving roller via said endless belt member and a second region in which said second reinforcing member opposes said driving roller via said endless belt member.

10. An image forming apparatus comprising:

a plurality of image bearing members each for bearing a toner image;

a rotatable endless belt for receiving a toner image thereon or for conveying a transfer material onto which the toner image is to be transferred;

a first reinforcing member, provided on an outer peripheral surface of said endless belt at one end portion with respect to a belt widthwise direction perpendicular to a movement direction of said endless belt, for reinforcing said endless belt;

a second reinforcing member, provided on the outer peripheral surface of said endless belt at the other end portion with respect to the belt widthwise direction perpendicular to the movement direction of said endless belt, for reinforcing said endless belt; and a driving roller for rotationally driving said endless belt while supporting an inner peripheral surface of said endless belt, wherein in the belt widthwise direction, a first length from an inner edge surface of said first reinforcing member to an inner edge surface of said second reinforcing member is smaller than a width of a region in which said driving roller contacts said endless belt, and a second length from an outer edge surface of said first reinforcing member to an outer edge surface of said second reinforcing member is larger than the width of the region in which said driving roller contacts said endless belt, and wherein said endless belt is free of a projected portion projecting from the inner peripheral surface over the belt widthwise direction.

11. A belt unit comprising:

a rotatable endless belt, free of a projected portion projecting from an inner peripheral surface over a belt widthwise direction, for receiving a toner image thereon or for conveying a transfer material;

a first reinforcing member, provided on an outer peripheral surface of said endless belt at one end portion with respect to the belt widthwise direction perpendicular to a movement direction of said endless belt, for reinforcing said endless belt;

a second reinforcing member, provided on the outer peripheral surface of said endless belt at the other end portion with respect to the belt widthwise direction perpendicular to the movement direction of said endless belt, for reinforcing said endless belt; and a driving roller for rotationally driving said endless belt while supporting the inner peripheral surface of said endless belt, wherein in the belt widthwise direction, a first length from an inner edge surface of said first reinforcing member to an inner edge surface of said second reinforcing member is smaller than a width of a region in which said driving roller contacts said endless belt, and wherein when said endless belt is shifted toward the one end portion, said endless belt is moved toward the other end portion by a first region, in which said second reinforcing member rides on said driving roller via said endless belt member, larger than a second region in which said first reinforcing member rides on said driving roller via said endless belt member.

* * * * *